US007460823B2

(12) United States Patent
Asakura et al.

(10) Patent No.: US 7,460,823 B2
(45) Date of Patent: Dec. 2, 2008

(54) IMAGE FORMING APPARATUS AND FIXER FLUID APPLYING ROLLER

(75) Inventors: Kenji Asakura, Kyoto (JP); Shinji Yamana, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 372 days.

(21) Appl. No.: 11/295,469

(22) Filed: Dec. 7, 2005

(65) Prior Publication Data

US 2006/0133866 A1 Jun. 22, 2006

(30) Foreign Application Priority Data

Dec. 8, 2004 (JP) ..... P2004-355956

(51) Int. Cl.
*G03G 15/20* (2006.01)
*G03G 15/16* (2006.01)

(52) U.S. Cl. ..... 399/340; 399/296; 399/307

(58) Field of Classification Search ..... 399/296, 399/307, 320, 339, 340
See application file for complete search history.

(56) References Cited

U.S. PATENT DOCUMENTS 5,666,628 A 9/1997 Fukai
6,195,523 B1 * 2/2001 Sakai ..... 399/296
6,496,676 B1 * 12/2002 Caruthers et al. ..... 399/296
2002/0180854 A1 12/2002 Sato et al.
2004/0131402 A1 * 7/2004 Kurotori et al. ..... 399/340

FOREIGN PATENT DOCUMENTS

JP 7-44034 A 2/1995
JP 11-084890 3/1999
JP 2002-292989 10/2002
JP 2004-109747 A 4/2004
JP 2004-109751 A 4/2004
JP 2004-294847 10/2004

* cited by examiner

*Primary Examiner*—Sandra L Brase
(74) *Attorney, Agent, or Firm*—Nixon & Vanderhye, P.C.

(57) ABSTRACT

An image forming apparatus is provided in which a toner image is fixed onto a recording medium with use of a fixer fluid in liquid form without causing generation of curls and wrinkles in the recording medium, the amount of the fixer fluid to be used can be reduced, even a multi-color toner image can be fixed in a short period of time, and power consumption is small. The image forming apparatus includes a toner image forming section, an intermediate transfer section, a secondary transfer section, a fixing section, and a recording medium supply section. A fixer fluid applying section included in the fixing section applies a fixer fluid to an image portion and a non-image portion of a recording medium. The quantity of applying the fixer fluid for a non-image portion is smaller than that for a image portion.

23 Claims, 7 Drawing Sheets

IMAGE FORMING APPARATUS AND FIXER FLUID APPLYING ROLLER

BACKGROUND OF THE INVENTION

1. Field of the Invention

The present invention relates to an image forming apparatus and a fixer fluid applying roller.

2. Description of the Related Art

An electrophotographic system-based image forming apparatus finds wide application in copying machines, printers, facsimile machines, or the like equipment. In general, image formation is accomplished in the following manner. Firstly, there is prepared a photosensitive body having a photosensitive layer containing a photoconductive substance formed on the surface thereof. After the surface of the photoreceptor is electrically charged uniformly, an electrostatic latent image corresponding to image data is formed thereon through a few different image-forming process steps. The electrostatic latent image is developed into a toner image with use of a developing agent containing toner supplied from development means. The toner image is directly transferred onto a recording medium such as a paper sheet, or transferred onto an intermediate transfer medium once, and is thereafter transferred onto a recording medium. On the recording medium, the toner image is heated and pressurized, and is eventually fixed thereon by fixing means such as a development roller according to a heat fixing method.

However, the heat fixing method necessitates a heating device such as a heater which contributes to an increase in power consumption. In reality, the amount of power consumed in a heat fixing process accounts for half or more of the total power consumption entailed by all of the operations performed by the electrophotographic image forming apparatus. On the contrary, energy conservation has been addressed globally as part of efforts to prevent global warming. In the light of the widespread use of such an electrophotographic image forming apparatus, a reduction in power consumption required to fix a toner image onto a recording medium has come to be increasingly demanded on the electrophotographic image forming apparatuses. Another problem peculiar to the heat fixing method is that much time needs to be spent in fixing a multi-color toner image onto a recording medium as compared to the case of fixing a monochromatic toner image. Hence, reduction in time required to fix a multi-color toner image has also been sought after.

As an attempt to meet such demands, there has been known the use of a so-called wet fixing method using a fixer fluid containing water and a liquid which is soluble or dispersible in water and has a toner-softening or toner-swelling effect. According to the wet fixing method, toner is kept in a softened or swelled state through the application of such a fixer fluid. A toner image which is constituted by the toner in this state is attached to a recording medium and is fixed thereonto by pressurization. The wet fixing method consumes far less power than the heat fixing method, and therefore it can be said that this is an excellent fixing method in terms of energy saving. Another advantage is that the time required to fix a multi-color toner image can be reduced successfully in contrast to the heat fixing method that produces a large amount of heat. In view of the foregoing, to date various proposals have been made as to further improvement to the wet fixing method.

For example, there has been proposed a fixing apparatus in which a jet of fixer fluid ejected from a fixer fluid ejecting member having a plurality of pores is applied relatively to a toner image carried on an intermediate transfer medium or a recording medium. In this construction, the fixer fluid is applied only to a part to which toner is attached (for example, refer to Japanese Unexamined Patent Publication JP-A 2004-109751). According to this fixing apparatus, the application of the fixer fluid helps prevent generation of curls and wrinkles in a recording medium. Moreover, in order to reduce the amount of the fixer fluid to be used, the fixer fluid is applied only to that part of a recording medium to which toner is attached, which will be referred to as "image portion". That is, the fixer fluid is not applied to a toner-absent part of a recording medium, which will be referred to as "non-image portion". In this construction, however, upon the fixer fluid being applied locally to a recording medium, the image portion undergoes expansion and contraction, whereas the non-image region remains unchanged. It is thus inevitable that wrinkles are generated in and around the image portion. Generation of wrinkles is particularly notable in the case of using a recording medium produced by entwining fibers dispersed in water. As a matter of course, such an inconvenience can be prevented from occurring by keeping the amount of the fixer fluid necessary to swell out toner at a minimum. However, since the minimum necessary amount of the fixer fluid is minimal, it is quite difficult to obtain a predetermined minimum value by calculation with high accuracy. Another disadvantage is that, when the fixer fluid is applied only to the toner-applied part, toner inadvertently attached to the non-image portion located near the toner-applied part by fogging remains unfixed on a recording medium, causing a smear in user's hands or clothing.

As another example, there has been proposed an image forming apparatus composed of: an intermediate transfer medium; toner image forming means for holding a toner image on the intermediate transfer medium; fixing means for fixing toner onto a recording material by applying a fixer fluid which is capable of solving or swelling the toner in such a way that the fixer fluid is attached only to the toner present on the intermediate transfer medium, with a toner-absent part kept free of the fixer fluid; and transfer means for transferring the toner image formed on the intermediate transfer medium onto the recording material (for example, refer to Japanese Unexamined Patent Publication JP-A 2004-109747). In this image forming apparatus, although the fixer fluid is applied to the toner image formed on the intermediate transfer medium, at the time of transferring the toner image formed on the intermediate transfer medium onto the recording medium, not only the toner image but also the fixer fluid may be attached to the recording medium. Accordingly, in this image forming apparatus, just as is the case with the image forming apparatus disclosed in JP-A 2004-109751, generation of small, but appreciable wrinkles is inevitable. JP-A 2004-109747 also discloses an implementation example of the above-described image forming apparatus in which the intermediate transfer medium is subjected to a liquid-repellent treatment so as for its surface to exhibit liquid repellency against the fixer fluid. In this construction, it is unlikely that the fixer fluid is impregnated into the intermediate transfer medium. Thus, at the time of transferring the toner image formed on the intermediate transfer medium onto the recording medium, almost all of the amount of the fixer fluid is transferred onto the recording medium together with the toner image. As a consequence, the recording medium tends to curl or wrinkle more significantly.

As yet another example, there has been proposed a wet fixing method whereby fixation of toner is achieved by spraying or dropping a fixer fluid toward a yet-to-be-fixed toner image carried on a recording medium, followed by drying the recording medium. The fixer fluid in use is prepared by dispersing, in water, an organic compound which is insoluble or poorly-soluble in water and has a toner-solving or toner-swelling effect (for example, refer to Japanese Unexamined Patent Publication JP-A 7-44034 (1995)). Specific examples of the organic compound which is insoluble or poorly-soluble in water and has a toner-solving or toner-swelling effect include: an organic ester compound; an organic hydrocarbon compound; a fatty acid compound; an organic ketone compound; a halogenated hydrocarbon compound; an aldehyde compound; an ether-series compound; a heterocyclic compound; an alcohol compound; and an organic nitrogen compound. In the wet fixing method disclosed in JP-A 7-44034, however, the fixer fluid is applied to substantially the entire image forming region (toner image-presenting region) on the surface of the recording medium, regardless of a distinction between an image portion and a non-image portion. Therefore, in the case of using a paper material containing cellulose fibers as the recording medium, the recording medium tends to curl or wrinkle significantly.

SUMMARY OF THE INVENTION

An object of the invention is to provide an image forming apparatus in which a toner image is fixed onto a recording medium with use of a fixer fluid in liquid form without causing generation of curls and wrinkles in the recording medium, the amount of the fixer fluid to be used can be reduced, even a multi-color toner image can be fixed in a relatively short period of time and power consumption is small, and a fixer fluid applying roller used in the image forming apparatus.

One or more non-limiting example embodiments provide an image forming apparatus comprising:

a toner image forming section for forming a toner image, which is constituted by a toner that contains binder resin and is charged as a predetermined polarity, on a toner carrying surface of a recording medium; and a fixer fluid applying section for applying a fixer fluid, which is prepared as a liquid for softening or swelling the toner, to an entirety of the toner carrying surface of the recording medium, wherein the fixer fluid applying section performs application of the fixer fluid in such a way that a quantity of applying the fixer fluid for a non-image portion of the toner carrying surface on which the toner is not carried is smaller than that for an image portion of the toner carrying surface on which the toner image is formed, in terms of application amount of the fixer fluid per unit area.

The example embodiment(s) further provide(s) an image forming apparatus comprising;

an intermediate transfer medium;

a toner image forming section for forming a toner image, which is constituted by a toner that contains binder resin and is charged as a predetermined polarity, on a toner carrying surface of the intermediate transfer medium;

a fixer fluid applying section for applying a fixer fluid, which is prepared as a liquid for softening or swelling the toner, to an entirety of the toner carrying surface of the intermediate transfer medium; and a transfer section for transferring the toner image carried on the intermediate transfer medium onto a recording medium, wherein the fixer fluid applying section performs application of the fixer fluid in such a way that a quantity of applying the fixer fluid for a non-image portion of the toner carrying surface on which the toner is not carried is smaller than that for an image portion of the toner carrying surface on which the toner image is formed, in terms of application amount of the fixer fluid per unit area.

According to the non-limiting example(s), the image forming apparatus applies the fixer fluid to the entirety of the toner carrying surface of the recording medium or the intermediate transfer medium, by means of the fixer fluid applying section. In this time, the application of the fixer fluid is controlled in such a way that the image portion and the non-image portion differ from each other in terms of application amount of the fixer fluid per unit area, more specifically, in such a way that the non-image portion is smaller than the image portion in terms of application amount of the fixer fluid per unit area. By doing so, in contrast to the case of applying the fixer fluid only to the image portion, it is possible to minimize the difference in degree of expansion and contraction between the image portion and the non-image portion, and thereby substantially eliminate the possibility of expansion and contraction taking place locally. Therefore, generation of curls and wrinkles can be prevented from occurring in the recording medium. As another advantage, even if the toner is attached inadvertently to the non-image portion due to fogging, since the fixer fluid is applied also to the non-image portion, it follows that such a fogging toner portion can be fixed properly, thereby preventing occurrence of a smear in user's hands or clothing. As still another advantage, the internal temperature of the image forming apparatus is lower than that of a conventional image forming apparatus employing the heat fixing method. This helps facilitate removal of paper sheets in the event of paper jamming.

It is preferable that a surface roughness of the toner carrying surface of the intermediate transfer medium is, on the basis of a center line average roughness (Ra), set to be equal to or smaller than ⅕ of a volume average particle diameter of the toner.

The surface roughness of the toner carrying surface of the intermediate transfer medium is, on the basis of the center line average roughness (Ra), set to be equal to or smaller than ⅕ of the volume average particle diameter of the toner. In this case, the amount of the fixer fluid to be used can be reduced successfully without impairing the fixability and fixation speed of the toner image with respect to the recording medium. That is, the smaller the surface roughness, the higher the surface smoothness. Incidentally, the toner has an extremely small volume average particle diameter of, at most, a dozen μm or so. Therefore, by setting the surface roughness, in terms of center line average roughness, of the toner carrying surface of the intermediate transfer medium to be equal to or smaller than ⅕ of the volume average particle diameter of the toner, it is possible to attain sufficiently high surface smoothness. The toner carrying surface having high surface smoothness is small in surface area, and is thus less prone to adhesion of the fixer fluid. On the other hand, the toner image may be likened to a porous body formed of an aggregate of toner particles, and is thus large in surface area. The larger the number of toner particles constituting the porous body, the larger the surface area of the toner image. Hence, the amount of the fixer fluid adherent to the toner image-present portion (image portion) is larger than the amount of the fixer fluid adherent to that part of the toner carrying surface having high surface smoothness on which the toner is not carried (non-image portion). In this way, the application amount of the fixer fluid can be controlled in accordance with the amount of the toner per unit area on the toner carrying surface. That is, it is possible to control the application amount of the fixer fluid separately for the image portion and the non-image portion on an individual basis.

It is preferable that the fixer fluid applying section includes a coating member which has, on its surface, at least an elastically deformable porous layer for retaining the fixer fluid, and is rotatable about its axis, and that in a state where the coating member is rotated while being kept in pressure-contact with the toner carrying surface of the intermediate transfer medium, the fixer fluid retained in the porous layer of the coating member is applied to the toner carrying surface in a contact manner.

Used as the fixer fluid applying section is the coating member which has, on its surface, at least an elastically deformable porous layer for retaining the fixer fluid, and is rotatable about its axis. The coating member is rotated while being kept in pressure-contact with the toner carrying surface of the intermediate transfer medium, and, in this state, the fixer fluid is applied to the toner carrying surface in a contact manner. In this case, it never occurs that the fixer fluid retained in the porous layer builds up at the entrance of the contact portion between the coating member and the intermediate transfer medium that will eventually form a meniscus. As a result, while the fixer fluid is making contact with the toner image, the toner image is free from irregularities ascribable to the flow of the fixer fluid, which leads to production of an image of high quality and high resolution. Moreover, the porous layer of the coating member has a multiplicity of fine pores capable of retaining the fixer fluid, and is also elastically deformable in conformity with the configuration of a target object on contact. Therefore, where the target object has a three-dimensional structure like the toner image present in the image portion, as the porous layer becomes deformed, a large amount of the fixer fluid is caused to ooze out through the fine pores, which results in an increase in application amount of the fixer fluid per unit area. By way of contrast, where the target object has a flat surface like the non-image portion, the porous layer of the coating member is less deformable, and thus only a small amount of the fixer fluid is caused to ooze out through the fine pores. Moreover, an excess amount of the fixer fluid is absorbed through the fine pores under a capillary phenomenon, which results in a decrease in application amount of the fixer fluid per unit area. In this way, the application amount of the fixer fluid per unit area can be so controlled that the application amount varies between the image portion and the non-image portion.

It is preferable that the intermediate transfer medium has a smooth surface that is rotatable about its axis, the fixer fluid applying section includes a coating member which has an elastic layer formed on a surface thereof, and is rotatable about its axis, the coating member is brought into contact with the intermediate transfer medium under a constant pressure force, and in a state where the coating member carrying a thin layer of the fixer fluid on its surface is rotated while being kept in pressure-contact with the intermediate transfer medium, the coating member and the intermediate transfer medium are brought into contact with each other under a pressure force such as to allow passage of the fixer fluid carried on the surface of the coating member through a contact portion between the coating member and the intermediate transfer medium.

Used as the intermediate transfer medium is a member having a smooth surface that is rotatable about its axis. The fixer fluid applying section is provided with the coating member which has an elastic layer formed on the surface thereof, and is rotatable about its axis. Moreover, The coating member is brought into pressure-contact with the intermediate transfer medium. A thin layer of the fixer fluid is formed on the surface of the coating member. Then, a pressure force such as to allow passage of the fixer fluid through a contact portion (nip portion) between the coating member and the intermediate transfer medium, is exerted on the coating member. This enables the thin layer of the fixer fluid formed on the surface of the coating member to pass smoothly through the contact portion between the coating member and the intermediate transfer medium. In this case, it never occurs that the fixer fluid builds up at the entrance of the contact portion that will eventually form a large meniscus. As a result, the coating member is brought into pressure-contact with the intermediate transfer medium, with the fixer fluid layer lying therebetween. Moreover, while the fixer fluid is making contact with the toner image, the fixer fluid is inhibited from flowing greatly, and the toner image is free from irregularities accordingly. This makes possible production of an image of high quality and high resolution. Further, being made of an elastic material, the surface of the coating member becomes deformed in conformity with the asperities of the toner image. Therefore, in the toner image-present portion, the coating member is brought into pressure-contact with the toner image through the fixer fluid layer. In this way, on the toner carrying surface of the intermediate transfer medium, even if the toner amount varies from part to part, the fixer fluid can be applied uniformly. For example, even if the toner amount varies greatly from part to part for a case where, for example, a multi-color toner image is formed, the multi-color toner image can be fixed uniformly without fail. This makes production of a high-quality image possible. Moreover, since the intermediate transfer medium has a smooth surface and the coating member has an elastic layer formed on the surface thereof, it follows that the image portion in which the toner image that is an aggregate of toner particles (porous body) is formed receives the fixer fluid in a larger amount, whereas the non-image portion in which the toner is not carried on the toner carrying surface receives the fixer fluid in a smaller amount. That is, by utilizing the intermediate transfer medium having a smooth surface and the coating member having an elastic layer formed on its surface in combination, and also by exerting, on the coating member, a pressure force such as to allow passage of the fixer fluid layer formed on the surface of the coating member through the contact portion between the coating member and the intermediate transfer medium, it is possible to control the application amount of the fixer fluid per unit area, and thereby apply the fixer fluid to the image portion and the non-image portion separately in different amounts.

It is preferable that a pressure force under which the coating member and the intermediate transfer medium are brought into contact with each other is set to a linear pressure falling in a range of from 0.05 N/cm to 1.0 N/cm.

A pressure force to be exerted on the coating member is set to a linear pressure falling in a range of from 0.05 N/cm to 1.0 N/cm. Thus, it is possible to prevent unevenness in fixer-fluid application more successfully, and thereby prevent occurrence of lack of uniformity in glossiness or coloration in a resultant image. It is also possible to further reduce the irregularities of the toner image ascribable to the flow of the fixer fluid, and thereby produce a high-quality image that is free from irregularities.

It is preferable that a difference between a contact angle of the surface of the coating member with respect to the fixer fluid and a contact angle of the surface of the intermediate transfer medium with respect to the fixer fluid is equal to or smaller than 20 degrees.

By adjusting the difference between the contact angle of the surface of the coating member with respect to the fixer fluid and the contact angle of the surface of the intermediate transfer medium with respect to the fixer fluid to be 20 degrees or below, it is possible to apply the fixer fluid of adequate amount also to the non-image portion. This helps prevent more successfully generation of wrinkles or the like from occurring in the non-image portion, as well as at and around the boundary between the image portion and the non-image portion, on the recording medium.

It is preferable that the fixer fluid applying section includes:

an atomizer section for atomizing the fixer fluid to form misty droplets of the fixer fluid and spraying the misty droplets of the fixer fluid;

a charging section for charging the misty droplets of the fixer fluid in a polarity reverse to a polarity of the charged toner; and a transporting section for allowing the charged misty droplets of the fixer fluid to come near the toner image, and that the transporting section generates an electric field between the toner carrying surface and the atomizer section in a direction such as to force the charged misty droplets of the fixer fluid to move toward the toner image.

As the fixer fluid applying section, an apparatus is used including the atomizer section for spraying the fine misty droplets of the fixer fluid, the charging section for charging the misty droplets of the fixer fluid in a polarity reverse to the polarity of the charged toner, and the transporting section for allow the misty droplets of the fixer fluid to come near the toner image by generating an electric field in a direction such as to force the charged misty droplets of the fixer fluid toward the toner image. In this construction, the fixer fluid can be applied to the toner image in accordance with the amount of electric charge carried on the toner. Therefore, only a small amount of the fixer fluid is applied to the non-image portion in which the toner is not carried on the toner carrying surface, namely, the surface of the recording medium or the intermediate transfer medium. This helps prevent generation of wrinkles or the like in the recording medium while reducing the amount of the fixer fluid to be consumed.

It is preferable that a potential of the non-image portion of the toner carrying surface is identical with that of the misty droplet of the fixer fluid, or falls in between a potential of the misty droplet of the fixer fluid and a potential of the charged toner.

The potential of the non-image portion of the toner carrying surface is identical with that of the misty droplet of the fixer fluid, or falls in between the potential of the misty droplet and the potential of the charged toner. In this case, the fixer fluid can be applied to the toner image in a highly selective manner.

It is preferable that the fixer fluid applying section includes a nozzle array for applying the fixer fluid in droplet form to the toner carrying surface in response to an image signal.

As the fixer fluid applying section, a nozzle array, for example, a nozzle array designed for use in an ink-jet system is used. The nozzle array applies the fixer fluid in droplet form to the toner carrying surface in response to an image signal. In this construction, the application amount and distribution of the fixer fluid can be controlled in accordance with an electric signal based on the image signal. This makes it possible to achieve both prevention of wrinkle generation in the recording medium and reduction of the amount of the fixer fluid to be consumed at a higher level. Moreover, since the fixer fluid is applied to a yet-to-be-fixed toner image in a non-contact manner, it follows that the toner image suffers little from irregularities.

It is preferable that the amount of the fixer fluid to be applied to the non-image portion of the toner carrying surface is varied according to a distance with respect to the toner image.

In the case of using the nozzle array as the fixer fluid applying section, on the toner carrying surface, the amount of the fixer fluid to be applied to the non-image portion is varied according to a distance with respect to the toner image. More specifically, to the image portion is applied the fixer fluid in an amount necessary to fix the toner. To the region near the boundary between the image portion and the non-image portion is applied the fixer fluid in an amount smaller than the amount set for the image portion, so as for the recording medium to contract to the same degree as the image portion. To the non-image portion located away from the image portion is applied the fixer fluid in a further smaller amount. In this way, both prevention of wrinkle generation resulting from contraction of the recording medium and further reduction of the amount of the fixer fluid to be consumed can be achieved more successfully.

It is preferable that the droplet or the misty droplet of the fixer fluid produced by the fixer fluid applying section has a particle diameter which is 5 times smaller than a volume average particle diameter of the toner.

In the fixer fluid applying section, the fixer fluid is put into a misty-droplet state, or put into a droplet state by the nozzle array. In either case, the particle diameter of the fixer fluid in droplet form or in misty-droplet form is set to be 5 times smaller than the volume average particle diameter of the toner. This makes it possible to prevent agglomeration of toner particles in accompaniment with the attachment of the fixer fluid, and thereby produce an image which is excellent in uniformity and quality. Moreover, the fixer fluid in microscopic-droplet form can be applied uniformly also to the entire non-image portion with a reduced amount of the fixer fluid.

It is preferable that the image forming apparatus further comprises a heating section for heating the intermediate transfer medium, and that the toner image which is an aggregate of toner particles formed on the intermediate transfer medium and which has spaces among the toner particles, is heated to a temperature such that disappearance of the spaces among the toner particles is not caused, and then the fixer fluid is applied to the toner image in a heated state.

It is preferable that the temperature such that disappearance of the spaces among the toner particles is not caused, is a temperature that is equal to or higher than a class transition temperature of the binder resin contained in the toner particle and lower than a softening point of the binder resin.

The image forming apparatus further comprises the heating section for heating the intermediate transfer medium. By the action of the heating section, the toner image which is an aggregate of toner particles formed on the intermediate transfer medium and which has the spaces among the toner particles, is heated to a temperature such that the disappearance of spaces among the toner particles is not caused, preferably, the temperature that is equal to or higher than the glass transition temperature of the binder resin contained in the toner and lower than the softening point of the binder resin. Then, the fixer fluid is applied to the toner image in a heated state. In this case, the adherability between the toner image and the intermediate transfer medium can be enhanced. Hence, for example, in the case of applying the fixer fluid to the toner image by the coating member in a contact manner, the toner image can be inhibited from adhering to the coating member more successfully. This makes it possible to produce a high-quality image that is free from problems such as irregularities or chipping.

It is preferable that the image forming apparatus further comprises a heating section for heating the intermediate transfer medium, and that the toner image formed on the intermediate transfer medium with use of a toner containing, in addition to a binder resin, a wax component which is lower in softening point than the binder resin, is heated to a temperature that is equal to or higher than the softening point of the wax component and lower than the softening point of the binder resin, and then the fixer fluid is applied to the toner image in a heated state.

It is preferable that the temperature to which the toner image formed on the intermediate transfer medium is heated is a temperature close to the softening point of the wax component.

A toner image is formed on the intermediate transfer medium with use of a toner containing, in addition to a binder resin, a wax component which is lower in softening point than the binder resin. The toner image is heated to a temperature that is equal to or higher than the softening point of the wax component and lower than the softening point of the binder resin, preferably, the temperature close to the softening point of the wax component. Then, the fixer fluid is applied to the toner image in a heated state. In this case, the adherability between the toner image and the intermediate transfer medium can be enhanced; wherefore the toner image can be inhibited from adhering to the coating member more successfully. This makes it possible to produce a high-quality image that is free from problems such as irregularities and chipping. Moreover, as the wax dispersed in the toner particle is softened, the fixer fluid finds its way swiftly into the toner particle and thus into the toner image; wherefore the toner is put into a softened state suitable for transference to the recording medium in a short period of time. This helps shorten the time interval from when the fixer fluid is applied to the toner carrying surface of the intermediate transfer medium and the toner image is transferred onto the recording medium. As a result, it is possible to lessen the spacing between the position at which the fixer fluid is applied and the position at which the toner image is transferred onto the recording medium, and thereby achieve further miniaturization of the image forming apparatus as a whole.

The example(s) further provide(s) a fixer fluid applying roller for applying a fixer fluid to a toner image in a contact manner, comprising:

a hollow shaft;

a permeation control layer formed on an outer surface of the core bar; and a porous layer formed on the outer surface of the permeation control layer, wherein the core bar stores the fixer fluid therein and has a plurality of fixer fluid supply holes formed so as to penetrate from the outer surface to an inner wall surface of the shaft in order to feed the fixer fluid into the permeation control layer, and the permeation control layer is made of an elastically deformable material which allows impregnation of the fixer fluid and retention of the fixer fluid in an impregnated state.

It is preferable that the permeation control layer is formed of foamed rubber or a felt, and the porous layer is formed of a porous film of fluorine resin.

A fixer fluid applying roller for applying a fixer fluid to a toner image in a contact manner, comprises the shaft, the permeation control layer formed on the surface of the shaft, and a porous layer formed on the surface of the permeation control layer. The shaft stores the fixer fluid therein and has a plurality of fixer fluid supply holes for feeding the fixer fluid into the permeation control layer. The permeation control layer is made of an elastically deformable material which allows impregnation of the fixer fluid and retention of the fixer fluid in an impregnated state, preferably, foamed rubber or a felt, and the porous layer is preferably formed of a porous film of fluorine resin. By using the fixer fluid applying roller to apply the fixer fluid to the toner carrying surface in a contact manner, the toner image is free from irregularities ascribable to building-up of the fixer fluid, which leads to production of an image of high quality and high resolution. Moreover, the porous layer of the fixer fluid applying roller has a multiplicity of fine pores capable of retaining the fixer fluid, and is also elastically deformable in conformity with the configuration of a target object on contact. Therefore, where the target object has a three-dimensional structure like the toner image present in the image portion, as the porous layer becomes deformed, a large amount of the fixer fluid is caused to ooze out through the fine pores, which results in an increase in application amount of the fixer fluid per unit area. By way of contrast, where the target object has a flat surface like the non-image portion, the porous layer of the coating member is less deformable, and thus only a small amount of the fixer fluid is caused to ooze out through the fine pores. Moreover, an excess amount of the fixer fluid is absorbed through the fine pores under a capillary phenomenon, which results in a decrease in application amount of the fixer fluid per unit area. In this way, the application amount of the fixer fluid per unit area can be so controlled that the application amount varies between the image portion and the non-image portion.

BRIEF DESCRIPTION OF THE DRAWINGS

Other and further objects, features, and advantages of the non-limiting example(s) will be more explicit from the following detailed description taken with reference to the drawings wherein.

DETAILED DESCRIPTION

Figure 1:
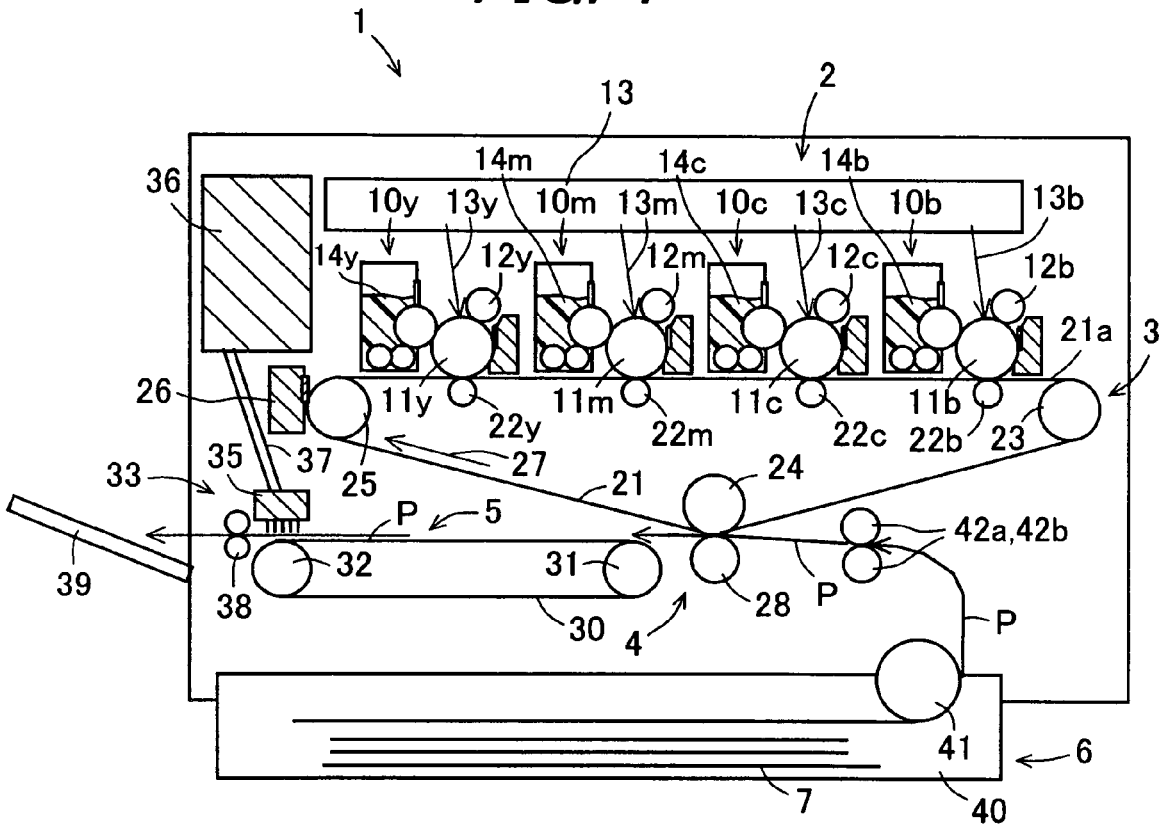
FIG. 1 is a sectional view schematically showing the constitution of an image forming apparatus according to a first non-limiting embodiment of the invention.

Now referring to the drawings, preferred embodiments of the invention are described below.

Figure 2:
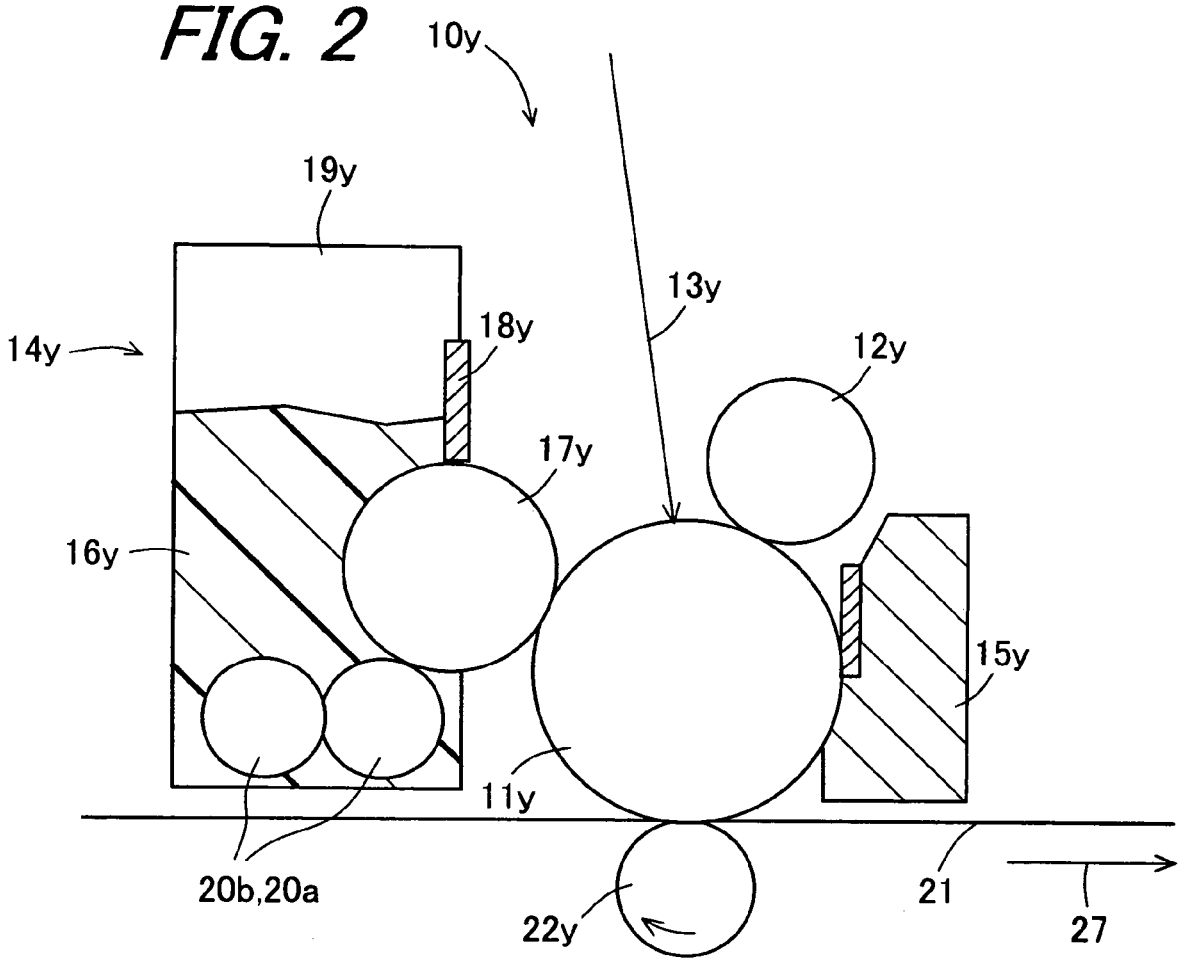
FIG. 2 is an enlarged sectional view showing the principal portion of the image forming apparatus depicted in FIG. 1.
Figure 3:
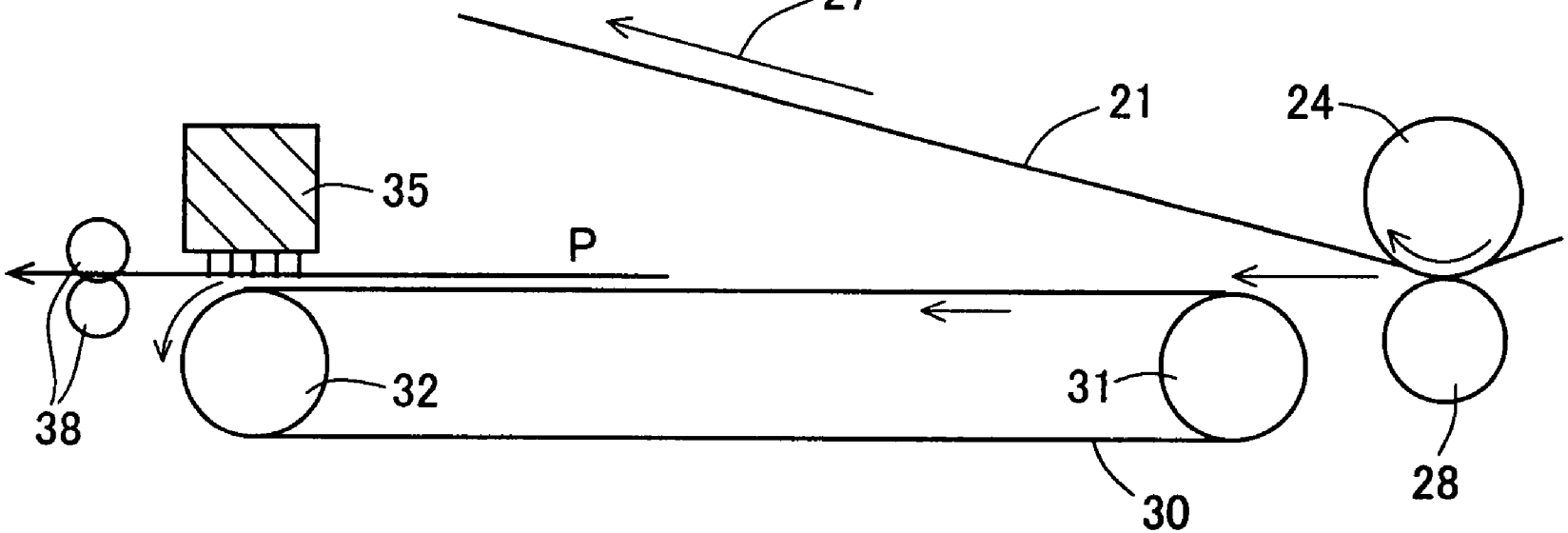
FIG. 3 is an enlarged sectional view showing the principal portion of the image forming apparatus depicted in FIG. 1.

FIG. 1 is a sectional view schematically showing the constitution of an image forming apparatus 1 according to a first non-limiting embodiment. FIG. 2 is an enlarged sectional view showing the principal portion (a toner image forming section 2 which will be described later) of the image forming apparatus 1 depicted in FIG. 1. FIG. 3 is an enlarged sectional view showing the principal portion (a secondary transfer section 4 and a fixing section 5 which will be described later) of the image forming apparatus 1 depicted in FIG. 1.

The image forming apparatus 1 includes the toner image forming section 2, an intermediate transfer section 3, the secondary transfer section 4, the fixing section 5, and a recording medium supply section 6.

The toner image forming section 2 includes image forming units 10*y*, 10*m*, 10*c*, and 10*b*, for forming toner images of different colors by developing individual electrostatic latent images formed on the basis of image data corresponding to different color components. More specifically, the image forming unit 10*y* is responsible for formation of a toner image corresponding to yellow image data; the image forming unit 10*m* is responsible for formation of a toner image corresponding to magenta image data; the image forming unit 10*c* is responsible for formation of a toner image corresponding to cyan image data; and the image forming unit 10*b* is responsible for formation of a toner image corresponding to black-color image data.

The image forming unit 10*y* includes a photoreceptor drum 11*y* upon which the laser light 13*y* is applied, a charging roller 12*y*, a development device 14*y*, and a drum cleaner 15*y*.

The photoreceptor drum 11*y*, which is so supported as to rotate about its axis by a driving section (not shown), includes a conductive substrate (not shown) formed in the shape of a cylinder, a cylindrical column, or a membrane sheet, preferably, a cylindrical conductive substrate, and a photosensitive layer formed on the surface of the conductive substrate. The photoreceptor drum 11*y* may be realized by the use of a photoreceptor drum construction for common use in the field of interest, for example, a 30 mm-diameter photoreceptor drum connected at a ground potential (GND), which is constructed by forming an organic photosensitive layer on a surface of an aluminum elementary pipe prepared for use as a conductive substrate. The organic photosensitive layer is formed by laminating a charge generating layer containing a charge generating substance and a charge transporting layer containing a charge transporting substance one after another. Alternatively, the organic photosensitive layer may be formed of a single layer containing both the charge generating substance and the charge transporting substance. For example, the layer thickness of the organic photosensitive layer is set at 20 μm. It is also possible to interpose an undercoat layer between the organic photosensitive layer and the surface of the photoreceptor drum, or to provide a protective layer on the surface of the organic photosensitive layer. The photoreceptor drum rotates in a clockwise direction at a circumferential velocity e.g. of 100 mm/s.

The charging roller 12*y* applies electric charge over the surface of the photoreceptor drum 11*y* with predetermined polarity and potential. Instead of the charging roller 12*y*, a brush-type charging device, a charger-type charging device, and a corona charging device such as a scorotron charger are also usable.

The light scanning unit 13 applies laser light 13*y* corresponding to the yellow image data to the electrically charged surface of the photoreceptor drum 11*y*, thereby forming an electrostatic latent image corresponding to the yellow image data on the surface of the photoreceptor drum 11*y*. As the source of the laser light 13*y*, for example, a semiconductor laser is employed.

The development device 14*y* includes a developing roller 17*y*, a developing blade 18*y*, a toner reservoir 19*y* and a pair of agitating rollers 20*a* and 20*b*. The developing roller 17*y* is brought into pressure-contact with the surface of the photoreceptor drum 11*y*, has a stationary magnetic pole (not shown) in its inside, and is rotatable about its axis. The developing roller 17*y* acts to feed the yellow toner 16*y* to the electrostatic latent image formed on the surface of the photoreceptor drum 11*y*. The developing blade 18*y* is disposed so as to abut on the surface of the developing roller 17*y*. The developing blade 18*y* acts to make uniform the toner layer thickness of the yellow toner 16*y* deposited on the surface of the developing roller 17*y* (layer regulation). The toner reservoir 19*y* stores therein an yellow toner 16*y*. The agitating rollers 20*a* and 20*b* are disposed inside the toner reservoir 19*y* in a state of being kept in contact with each other under pressure. The agitating rollers 20*a* and 20*b* are rotatable about their axes, of which the agitating roller 20*a* is brought into pressure-contact with the surface of the developing roller 17*y*. The agitating rollers 20*a* and 20*b* act to feed the yellow toner 16*y* to the surface of the developing roller 17*y*. The developing roller 17*y* rotates in the same direction as the rotation direction of the photoreceptor drum 11*y* at a development nip portion formed by keeping the developing roller 17*y* and the photoreceptor drum 11*y* in pressure-contact (or contact) with each other; that is, the developing roller 17*y* rotates in an opposite direction in terms of the axial rotation direction. In the present embodiment, the circumferential velocity of the developing roller 17*y* is set e.g. at 150 mm/s, which is 1.5 times faster than that of the photoreceptor drum 11*y*. The yellow toner 16*y* stored in the toner reservoir 19*y* is fed to the surface of the developing roller 17*y* by the agitating rollers 20*a* and 20*b*, and is then made uniform in toner layer thickness by the developing blade 18*y*. After that, the yellow toner 16*y* is substantially selectively fed to the electrostatic latent image formed on the surface of the photoreceptor drum 11*y* by exploiting a potential difference or other factors, thereby forming a toner image corresponding to the yellow image data. Note that, in the present embodiment, the yellow toner 16*y* in admixture with magnetic carriers is used as a two-component developing agent.

As will be described later, after the yellow toner image formed on the surface of the photoreceptor drum 11*y* is intermediately transferred onto an intermediate transfer belt 21, the drum cleaner 15*y* serves to remove and collect the residual toner remaining thereon.

According to the image forming unit 10*y*, toner image formation is effected as follows. At the outset, the surface of the photoreceptor drum 11*y* is electrically charged e.g. at −600 V by the charging roller 12*y*, while rotating the photoreceptor drum 11*y* about its axis. Next, the electrically charged surface of the photoreceptor drum 11*y* is irradiated with signal light corresponding to the yellow image data by the light scanning unit 13, thereby forming an electrostatic latent image corresponding to the yellow image data at an exposure potential of −70 V. Subsequently, the yellow toner layer carried on the surface of the developing roller 17*y* is brought into contact with the surface of the photoreceptor drum 11*y*. As a development potential, a d-c voltage of −240 V is applied to the developing roller 17*y*. By exploiting the resultant potential difference, the yellow toner 16*y* is attached to the electrostatic latent image, and the electrostatic latent image is then developed into an yellow toner image on the surface of the photoreceptor drum 11*y*. As will be described later, the yellow toner image is intermediately transferred onto the intermediate transfer belt 21 kept in contact with the surface of the photoreceptor drum 11*y*. The residual yellow toner 16*y* remaining on the surface of the photoreceptor drum 11*y* is removed and collected by the drum cleaner 15*y*. From then on, the above-described process steps for forming the yellow toner image are performed in the order named repeatedly.

The image forming units 10*m*, 10*c*, and 10*b* have basically the same structure as the image forming unit 10*y*, the main difference being the color of toner for use. That is, the image forming units 10*m* uses a magenta toner 16*m*, the image forming unit 10*c* uses a cyan toner 16*c*, and the image forming unit 10*b* uses a black toner 16*b*. Therefore, the corresponding components will be denoted by the same reference numerals, and yet the reference symbols are suffixed with "m", "c", and "b" that indicate magenta, cyan, and black, respectively, instead of "y", and overlapping descriptions will be omitted. The image forming units 10*y*, 10*m*, 10*c*, and 10*b* are aligned in a row in this order, from the upstream side along the running direction of the intermediate transfer belt 21 (sub-scanning direction), namely the direction indicated by an arrow 27.

The toners of different colors 16*y*, 16*m*, 16*c*, and 16*b* each contain a binder resin, a colorant, and a release agent. No particular limitation is imposed on the selection of a binder resin material so long as it is softened or swelled satisfactorily by a fixer fluid 34 which will be explained later. Specific examples thereof include: polystyrene; a homopolymer of a styrene derivative substitution; a styrene-series copolymer; polyvinyl chloride; polyvinyl acetate; polyethylene; polypropylene; polyester; and polyurethane. As the binder resin, these materials can either be used alone or by way of a mixture of two or more kinds. With consideration given to application to a color toner, it is desirable to use a binder resin material having a softening point in a range of from 100 to 150° C. and a glass transition temperature in a range of from 50 to 80° C. in terms of preservability, durability, and control of the softening or swelling effect brought about by the subsequently-explained fixer fluid 34. The use of polyester is particularly desirable, because it is easily softened and/or swelled by an easy-to-find organic solvent, and turns out to be transparent in a softened or swelled state. In this case, upon a multi-color toner image formed by superimposing toner images of different colors: yellow; magenta; cyan; and black one upon another being fixed by the fixer fluid 34, then polyester, or the binder resin per se turns out to be transparent. As a result, with the effect brought about by a subtractive color mixing, excellent coloration can be attained. Moreover, by using a resin material such as that which is higher in softening point and in hardness, that is, which is larger in molecular weight and is higher in hardness than a binder resin used to form a toner for use in the heat fixing method, a fixation process using the fixer fluid 34 can also be achieved properly. The use of a resin material having a high softening point and high hardness makes it possible to prevent image degradation resulting from application of a load in accompaniment with a development operation, and thereby obtain an image which suffers little from quality degradation for a longer period of time.

As a colorant, while it is possible to use known pigments or dyes that have conventionally been used to form toner in the field of electrophotographic image formation technology, the use of a pigment material which is insoluble in the fixer fluid 34 is desirable from the standpoint of preventing undesirable toner spreading caused by the fixer fluid 34. Therefore, some dyes like a nigrosin dye are not desirable. Specific examples of the colorant include: organic pigments such as azo-base pigments, benzimidazolone-base pigments, quinacridon-base pigments, phthalocyanine-base pigments, isoindolinone-base pigments, isoindoline-base pigments, dioxazine-base pigments, anthraquinone-base pigments, perylene-base pigments, perynone-base pigments, thioindigo-base pigments, quinophthalone-base pigments, or metal complex-base pigments; inorganic pigments such as carbon black, titanium oxide, molybdenum red, chrome yellow, titanium yellow, chrome oxide, or Berlin blue; and metal powder such as aluminum powder. As the colorant, these materials can either be used alone or by way of a mixture of two or more kinds.

As a release agent, wax materials of various types can be used. No particular limitation is imposed on the selection of a wax material so long as it is softened or swelled satisfactorily by the fixer fluid 34. Specific examples thereof include: a polyethylene wax; a polypropylene wax; and a paraffin wax.

In addition to the binder resin, the colorant, and the release agent, one kind or two kinds or more of commonly-used toner additives selected among from a charge control agent, a flowability enhancer, a fixation accelerator, a conducting agent, and the like may also be contained in the toner.

Although there is no particular limitation, the volume average particle diameter of the toner is preferably adjusted to fall in a range from 2 to 7 μm. The use of such a toner with a small particle size makes it possible to increase the surface area of the toner per unit area, and thereby increase the contact area between the toner and the fixer fluid 34, with the result that the toner fixing process can be facilitated. Hence, not only it is possible to reduce the amount of the fixer fluid 34 to be used, but it is also possible to achieve fixation of a toner image onto a recording medium and a post-fixation drying treatment as well in a shorter period of time. Moreover, where the toner has an adequately small volume average particle diameter, it is possible to attain a higher toner coverage rate with respect to a recording medium 7, and thereby produce a high-quality image with a small amount of adherent toner; that is, with a reduced amount of toner consumed. This leads to even further reduction in the amount of the fixer fluid 34 to be used.

Where the volume average particle diameter of the toner is less than 2 μm, the flowability of the toner is so low that none of toner supply, toner agitation, and toner charging can be achieved successfully during a development process. As a result, problems such as toner shortages or an undesirable increase of toner having an opposite polarity (reverse-polarity toner) arise, posing the risk of producing an image of poor quality. By way of contrast, where the volume average particle diameter of the toner exceeds 7 μm, there exist a large number of toner particles having a large particle diameter, each of which cannot be softened and/or swelled wholly, with its center part left unchanged. This leads to poor fixability of a toner image with respect to a recording medium, as well as to an image of poor color. In the case of performing image fixation on an OHP sheet in particular, quite inconveniently, a gloomy image may be produced.

Although there is no particular limitation, the toner in itself should preferably have a softening point in a range of from 100 to 130° C. and a glass transition temperature in a range of from 50 to 80° C. While such a toner having a high softening point is desirable from the standpoint of enhancing durability against a load applied in accompaniment with a development operation, it is neither fixed sufficiently nor exhibits proper color when used in the heat fixing method. However, according to non-limiting example(s), since the toner is chemically softened and/or swelled by using the fixer fluid 34, it follows that both fixation and coloration can be achieved satisfactorily, whereby making it possible to produce a high-quality image.

The production of the toner is carried out in conformity with conventionally-known manufacturing methods. For example, the toner can be produced by dispersing a release agent, a colorant, and other necessary agents in a binder resin, followed by pulverization, or produced by dispersing a release agent, a colorant, etc. in a binder resin monomer solution, followed by polymerization of the monomer of the binder resin. In either method, in order to increase the surface area of the toner, the toner particles should preferably be adjusted to take on indefinite shape rather than spherical shape. This helps facilitate the contact between the toner and the fixer fluid 34, with the result that the amount of the fixer fluid 34 to be used can be reduced and thus toner-image fixation and drying process can be achieved in a short period of time.

Each of the toners of different colors 16*y*, 16*m*, 16*c*, and 16*b* may be used as a one-component developing agent, or as a two-component developing agent in admixture with carriers.

In the present embodiment, the toners of different colors 16*y*, 16*m*, 16*c*, and 16*b* have the same structural property as described hereinbelow, except for the pigments contained. The toner is designed as an insulative non-magnetic toner to be negatively charged having a glass transition temperature of 60° C., a softening point of 120° C., and a volume average particle diameter of 6 μm. In order to obtain a predetermined image density at a reflection density value of 1.4 measured by means of a commercially available reflection densitometer type 310 manufactured by X-Rite, it is necessary to use the toner in an amount of 5 g/m$^2$. The toner contains polyester as a binder resin having a glass transition temperature of 60° C. and a softening point of 120° C., low-molecular polyethylene wax as a release agent having a glass transition temperature of 50° C. and a softening point of 70° C., and a pigment material of corresponding color. The wax content and the pigment content constitute 7% by weight and 12% by weight, respectively, of the toner mixture as a whole. The remainder is the binder resin. The low-molecular polyethylene wax contained in the toner is lower in glass transition temperature and in softening point than polyester, or the binder resin. The use of such a wax material makes it possible to increase toner-to-toner adherability and also the adherability between the toner and the intermediate transfer belt 21 or the recording medium 7, even under a temperature lower than the glass transition temperature of the binder resin. Therefore, at the time of the application of the fixer fluid 34 in liquid form, the toner can be prevented from flowing or coagulating under the influence of the fixer fluid 34. Another advantage is that, as the wax contained in the toner is softened, the fixer fluid 34 finds its way smoothly into the toner from a wax-present part thereof; wherefore the toner, in its entirety, can be softened and/or swelled in a short period of time in accompaniment with the application of the fixer fluid 34. As a result, sufficiently high fixation strength can be attained when the toner is transferred onto the recording medium 7. Further, an image formed by superimposing toner images of different colors one upon another succeeds in exhibiting good color.

The intermediate transfer section 3 includes the intermediate transfer belt 21, intermediate transfer rollers 22*y*, 22*m*, 22*c*, and 22*b*, supporting rollers 23, 24, and 25, and a belt cleaner 26.

The intermediate transfer belt 21 is designed as an endless belt stretched across the supporting rollers 23, 24, and 25, for forming a loop-like traveling path. The intermediate transfer belt 21 is rotated in the direction indicated by the arrow 27 at a circumferential velocity which is almost equal to that of the photoreceptor drum 11*y*, 11*m*, 11*c*, 11*b*. For example, the intermediate transfer belt 21 may be constituted by forming, on the surface of a 100 μm-thick polyimide film, a 20 μm-thick coating layer made of fluorine resin composition in which PTFE (polytetrafluoroethylene) and PFA (tetrafluoroethylene-perfluoroalkylvinylether copolymer) are contained at a ratio of 8:2 (by weight). The polyimide film and the coating layer each contain an electrically conductive material such as furnace type black, thermal type black, channel type black, or graphite carbon for the purpose of adjusting the electrical resistivity in the intermediate transfer belt 21. The surface of the coating layer acts as a toner carrying surface 21*a*. Note that the materials used to form the intermediate transfer belt 21 are not limited to those as set forth hereinabove, and any other material can be used instead so long as it is impervious to the fixer fluid 34. For example, the intermediate transfer belt 21 may be constituted by forming a coating layer made of PTFE and/or PFA on a film made of fluorine rubber or the like material.

The toner carrying surface 21*a* of the intermediate transfer belt 21 is brought into pressure-contact with the photoreceptor drums 11*y*, 11*m*, 11*c*, and 11*b* successively in the order named. The pressure-contact portion between the intermediate transfer belt 21 and each of the photoreceptor drums 11*y*, 11*m*, 11*c*, and 11*b*, is a position at which a toner image of the corresponding color component is intermediately transferred, namely, a toner-image intermediate transfer position. The intermediate transfer rollers 22*y*, 22*m*, 22*c*, and 22*b* are arranged so as to face the photoreceptor drums 11*y*, 11*m*, 11*c*, and 11*b*, respectively, with the intermediate transfer belt 21 lying therebetween.

The intermediate transfer rollers 22*y*, 22*m*, 22*c*, and 22*b* are each brought into pressure-contact with the other surface of the intermediate transfer belt 21 opposite to the toner carrying surface 21*a*, and are rotatable about their axes by a driving section (not shown). For example, the intermediate transfer rollers 22*y*, 22*m*, 22*c*, and 22*b* are each composed of a metal-made shaft body having its surface coated with an electrically conductive layer. The shaft body is made of a metal material such as stainless steel. Although there is no particular limitation, the diameter of the shaft body should preferably fall in a range from 8 to 10 mm. The electrically conductive layer is made of an electrically conductive elastic element or the like material. As an electrically conductive elastic element, those for common use in the field of interest can be selected, for example, EPDM, foamed EPDM, foamed urethane, and the like that contain a conductivity controlling agent such as carbon black. A high voltage is applied to the intermediate transfer belt 21 uniformly through the electrically conductive layer.

In order for the toner images formed on the surfaces of the photoreceptor drums 11*y*, 11*m*, 11*c*, and 11*b* to be transferred onto the intermediate transfer belt 21, an intermediate transfer bias of a polarity reverse to the polarity of the charged toner is impressed on the intermediate transfer rollers 22*y*, 22*m*, 22*c*, and 22*b* under constant-voltage control. In this way, the toner images of different color components: yellow color; magenta color; cyan color; and black color formed on the surfaces of the photoreceptor drums 11*y*, 11*m*, 11*c*, and 11*b*, respectively, are superimposedly transferred onto the toner carrying surface 21*a* of the intermediate transfer belt 21 one after another, thereby forming a multi-color toner image. Note that, in a case where image data consisting of a part of different color components of yellow, magenta, cyan and black is inputted for image formation, of the image forming units 10*y*, 10*m*, 10*c*, and 10*b*, only the one/ones corresponding to the input data are operated to achieve toner-image formation.

For example, the supporting rollers 23, 24, and 25 are each formed of an aluminum-made cylindrical body which is 30 mm in diameter and 1 mm in wall thickness. The supporting roller 24 is kept in pressure-contact with a secondary transfer roller 28 which will be explained later, with the intermediate transfer belt 21 lying therebetween, while being electrically connected to ground.

The belt cleaner 26 is a member for removing a residual toner which remains on the toner carrying surface 21*a* of the intermediate transfer belt 21 after the toner image formed on the toner carrying surface 21*a* is transferred onto the recording medium 7 by the secondary transfer section 4 which will be explained later. The belt cleaner 26 includes a cleaning blade and a toner reservoir. The cleaning blade is disposed so as to face the supporting roller 25, with the intermediate transfer belt 21 lying therebetween. The cleaning blade is brought into pressure-contact with the toner carrying surface 21*a* of the intermediate transfer belt 21 by a pressurizing section (not shown), and scraps off the residual toner remaining on the toner carrying surface 21*a* and so on. The toner reservoir stores therein the toner scraped off by the cleaning blade and soon. For example, the cleaning blade may be formed of a blade element made of a rubber material which exhibits elasticity (such as urethane rubber).

In the intermediate transfer section 3, the toner images of different colors formed on the surfaces of the photoreceptor drums 11*y*, 11*m*, 11*c*, and 11*b* are superimposedly transferred at a predetermined position on the toner carrying surface 21*a* of the intermediate transfer belt 21, thereby forming a desired toner image. After the toner image is transferred onto the recording medium 7 by the transfer section 4, the residual toner remaining on the toner carrying surface 21*a*, offset toner, paper powder, and other unnecessary matter are removed by the belt cleaner 26, so that another toner image can be transferred onto the toner carrying surface 21*a*.

The secondary transfer section 4 includes the secondary transfer roller 28 which is brought into pressure-contact with the supporting roller 24, with the intermediate transfer belt 21 lying therebetween, and is rotatable about its axis. For example, the secondary transfer roller 28 is constituted by forming a 4 mm-thick urethane rubber layer on the outer circumference of a 10 mm-diameter shaft. A conducting agent such as carbon is blended into the urethane rubber layer to impart electrical conductivity. Moreover, the secondary transfer roller 28 is pressed against the supporting roller 24 under a linear pressure, namely, a pressure acting on a predetermined line, e.g. of 1 N/cm. When the toner image Carried on the intermediate transfer belt 21 is transferred onto the recording medium 7 by the secondary transfer roller 28, a voltage e.g. of +1 kV is applied to the shaft of the secondary transfer roller 28.

In the secondary transfer section 4, the multi-color toner image carried on the intermediate transfer belt 21 is transferred onto the surface of the recording medium 7 under a press force. The recording medium 7 is fed from the subsequently-explained recording medium supply section 6 in synchronism with the conveyance of the intermediate transfer belt 21 with the multi-color toner image carried thereon toward a pressure-contact portion between the secondary transfer roller 28 and the supporting roller 24. The recording medium 7, now having the multi-color toner image transferred thereon, is then conveyed toward the fixing section 5.

The fixing section 5 includes a conveyance belt 30, a driving roller 31, a tension roller 32, and a fixer fluid applying section 33. The conveyance belt 30 conveys the recording medium 7 with the multi-color toner image transferred thereon toward the fixer fluid applying section 33 which will be explained later.

The conveyance belt 30 is designed as an endless belt stretched across the driving roller 31 and the tension roller 32, for forming a loop-like conveyance path For example, the conveyance belt 30 may be constituted by forming a 10 μm-thick surface layer made of PTFE on at least one of the surfaces of a 100 μm-thick polyimide film into which a conducting agent is blended to impart electrical conductivity.

The driving roller 31 is rotatable about its axis by a driving section (not shown). For example, the driving roller 31 may be composed of a hollow roller made of a metal material such as aluminum.

The tension roller 32 imparts a tension of predetermined level to the conveyance belt 30 to prevent the conveyance belt 30 from sagging down. For example, the tension roller 32 may be composed of a metal-made shaft body having its surface coated with a cover layer, or may be composed of the metal-made shaft body alone. Moreover, the tension roller 32 imparts a tension of predetermined level to the intermediate transfer belt 21 to prevent the intermediate transfer belt 21 from sagging down. For example, stainless steel is used to form the metal-made shaft body, and fluorine rubber is used to form the cover layer.

The fixer fluid applying section 33 includes a nozzle array 35, a fixer fluid reservoir 36 and a fixer fluid supply pipe 37. The nozzle array 35 applies the fixer fluid 34 to, of the entirety of the toner carrying surface of the recording medium 7. The fixer fluid reservoir 36 stores therein the fixer fluid 34. The fixer fluid supply pipe 37 supplies the fixer fluid 34 from the fixer fluid reservoir 36 to the nozzle array 35.

The nozzle array 35 is a device having a plurality of minute nozzles arranged in an array (not shown) for spitting microscopic droplets of the fixer fluid 34 toward the toner carrying surface of the recording medium 7 in response to an electric control signal. The pitch at which the minute nozzles are arranged is determined in such a way that the microscopic droplets of the fixer fluid 34 ejected from the minute nozzles cover, of the entirety of the toner carrying surface of the recording medium 7. Moreover, in the nozzle array 35, the diameter of the microscopic droplet can be changed suitably. By controlling the droplet diameter properly, it is possible to adjust the density of the number of fluid droplets to be applied (dot number). For example, the amount of the fixer fluid 34 to be applied can be controlled in a range of from 1 g/m$^2$ to 10 g/m$^2$. More specifically, given that the fixer fluid 34 adjusted to a density of 1 g/m$^2$ is applied to an image portion of the toner carrying surface, namely a toner image-present portion of the image-forming region at a droplet diameter of 26 μm and at a pitch of 30 μm, then the application amount (coverage amount) is given as 10 g/m$^2$. Moreover, given that the fixer fluid 34 adjusted to the same density is applied at a droplet diameter of 58 μm and at a pitch of 100 μm, then the application amount (coverage amount) is also given as 10 g/m$^2$. Further, given that the fixer fluid 34 adjusted to the same density is applied at a droplet diameter of 30 μm and at a pitch of 55 μm, then the application amount is given as 4.7 g/m$^2$. In the meantime, as to a non-image portion of the toner carrying surface on which the toner is not carried, for example, the amount of the fixer fluid 34 to be applied thereto is so adjusted to be given as 1 g/m$^2$.

Figure 4:
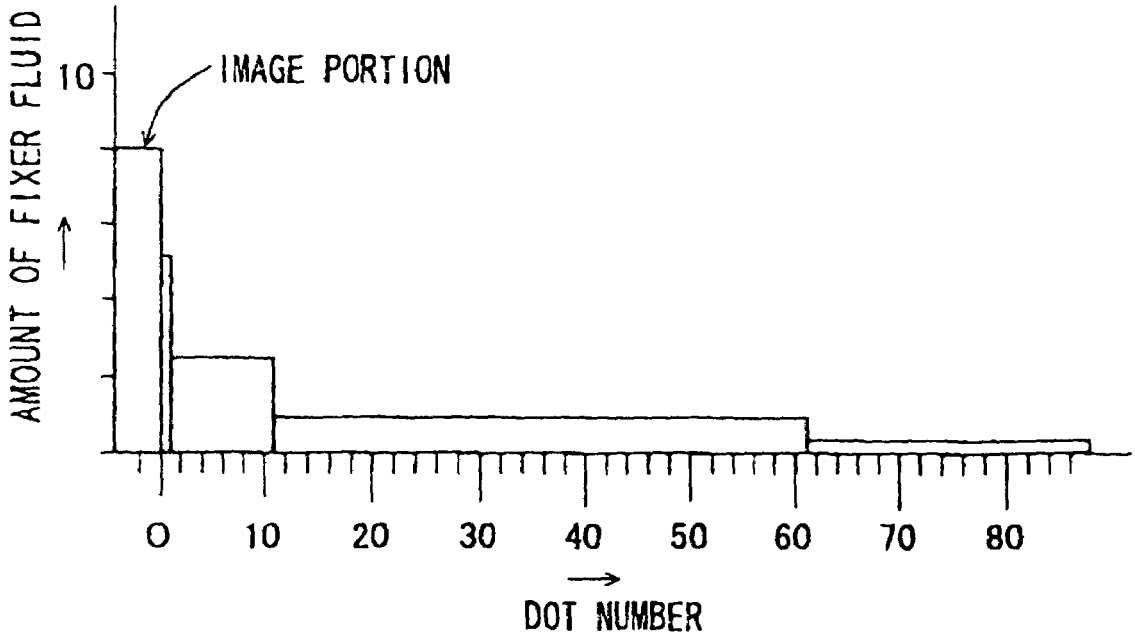
FIG. 4 is a graph indicating the relationship between the amount of the fixer fluid to be applied and a distance with respect to the image portion.

The amount of the fixer fluid 34 to be applied should preferably vary depending upon a distance with respect to the toner image. That is, to the image portion is applied the fixer fluid 34 in an amount necessary to fix the toner. Moreover, to a region near the boundary between the image portion and the non-image portion is applied the fixer fluid 34 in an amount smaller than the amount set for the image portion, so that the recording medium 7 is caused to contract to the same degree as the image portion. Further, to the non-image portion located away from the image portion is applied the fixer fluid 34 in a further smaller amount. To be more specific, one example is shown in FIG. 4 which is a graph indicating the relationship between the amount of the fixer fluid 34 to be applied and a distance with respect to the image portion. Note that, in FIG. 4, distances with respect to the edge of the image portion are expressed in dots, and a single dot represents a single microscopic droplet of the fixer fluid 34. In this example, as shown in FIG. 4, to the image portion is applied the fixer fluid 34 in a microscopic-droplet form at 8 g/m$^2$. Similarly, to the boundary between the image portion and the non-image portion is applied the fixer fluid 34 at 5 g/m$^2$, to a position 10 dots away from the boundary is applied the fixer fluid 34 at 2.5 g/m$^2$, to a position 50 dots away from the boundary is applied the fixer fluid 34 at 2 g/m$^2$, and to a position 100 dots away from the boundary is applied the fixer fluid 34 at 1 g/m$^2$. To still farther positions, though not shown in the figure, are each applied the fixer fluid 34 at 0.5 g/m$^2$ uniformly. By varying the amount of the fixer fluid 34 to be applied stepwisely according to the distance with respect to the image portion in that way, it is possible to prevent generation of wrinkles in the recording medium 7, as well as to reduce the amount of the fixer fluid 34 to be used in an image having many non-image portions in particular. Note that the application amount that varies with the distance from the edge of the image portion can be determined in a wide range in consideration of different image-related conditions such as a toner in use, the amount of toner to be used, or the area of a toner image. For example, the amount of the fixer fluid 34 to be applied to the image portion can be adjusted to fall in a range of from 15 to 5 g/m$^2$, that to be applied to the boundary can be adjusted to fall in a range of from 6 to 3 g/m$^2$, that to be applied to the position 10 dots away from the boundary can be adjusted to fall in a range of from 4 to 2 g/m$^2$, that to be applied to the position 50 dots away from the boundary can be adjusted to fall in a range of from 3 to 1 g/m$^2$, and that to be applied to the position 100 dots away from the boundary can be adjusted to fall in a range of from 2 to 0.5 g/m$^2$. Moreover, the dot intervals counted with respect to the boundary are not limited to the above-described 10 dot, 50 dot, and 100 dot intervals, but may be changeable depending upon the above stated image conditions. The important thing is that, the farther the dot position lies away from the image portion, the less application amount of the fixer fluid 34 the dot position receives.

Moreover, it is preferable that the diameter of a microscopic droplet of the fixer fluid 34 is set to be 5 times or less as small as the volume average particle diameter of the toner. In general, if the droplet diameter of the fixer fluid 34 is unduly large, at the instant when the fluid droplet is attached to a toner image, the toner particles near by are caused to agglomerate, which is liable to result in occurrence of minute unevenness in the toner image. Moreover, if the droplet diameter is far larger than the volume average particle diameter of the toner, the number of coagulative toner particles is so large that the resultant lack of uniformity in the toner image can be discerned visually. In this regard, the correlation between the size of a toner particle and the amount of fluid droplets appears to be of a matter of concern. That is, where the amount of fluid droplets is large, toner particles are normally swept away by the fluid droplets and eventually start to agglomerate. However, where the size of a toner particle is relatively large, it is unlikely that such a sweeping takes place. Hence, by adjusting the droplet diameter to be 5 times or less as small as the volume average particle diameter of the toner, it is possible to suppress the agglomeration of toner particles in accompaniment with the attachment of the fluid droplet to the toner image, and thereby obtain a uniform, high-quality image. Moreover, by applying the fixer fluid 34 in a microscopic-droplet form, it is possible to cover the entire non-image portion only with a small amount of the fixer fluid 34. As another advantage, the fixer fluid 34 can be applied also to a fogging toner portion attached to the non-image portion. Therefore, the fogging toner portion is also fixed onto the recording medium 7, thereby preventing occurrence of a smear in user's hands or clothing. For example, the diameter of the microscopic droplet of the fixer fluid 34 can be adjusted as appropriate by means of the nozzle array 35. Since the nozzle array 35 is designed based on a piezo system for use in an ink-jet type printer, by making adjustment to a voltage to be applied to a piezo element (piezoelectric element) as appropriate, the droplet diameter can be controlled in a desired manner.

By virtue of the nozzle array 35, in response to image signals, the fixer fluid 34 can be readily applied to the image portion and the non-image portion separately in different amounts. This makes it possible to obtain a variety of application patterns of the fixer fluid 34, and thereby achieve both prevention of wrinkle generation in the recording medium 7 and reduction of the amount of the fixer fluid 34 to be consumed at a higher level. Moreover, since the fixer fluid 34 is applied to a yet-to-be-fixed toner image in a non-contact manner, it follows that the toner image is kept in a stable state, which makes production of a high-quality image possible. In the present embodiment, the amount of the fixer fluid 34 to be applied to the image portion is given as 10 g/m$^2$, whereas the amount of the fixer fluid 34 to be applied to the non-image portion is given as 1 g/m$^2$.

The fixer fluid 34 stored in the fixer fluid reservoir 36 is fed, through the fixer fluid supply pipe 37, to the nozzle array 35 by a replenishment control section (not shown).

The fixer fluid 34 is a liquid preparation for softening or swelling the toner. Preferably, the fixer fluid 34 contains an organic compound having a toner-softening or toner-swelling effect (referred to as "toner fixing organic compound" hereinafter) and a liquid which is capable of solving or dispersing the toner fixing organic compound. Although no particular limitation is imposed on the selection of the liquid material so long as it is able to solve or disperse the toner fixing organic compound, the use of water is desirable. Hence, as one preferred example of the liquid preparation for softening and/or swelling the toner, a composition containing the toner fixing organic compound and water can be taken up. Being low in viscosity, water finds its way smoothly into the interface between toner particles, the contact surface between a toner particle and the recording medium 7, and so on. That is, the toner fixing organic compound is allowed to reach the interface between toner particles, the contact surface between a toner particle and the recording medium 7, and so on, to soften and/or swell the toner in an instant. Specific examples of the toner fixing organic compound include: alcohol groups such as methyl alcohol, ethyl alcohol, propyl alcohol, butyl alcohol, octyl alcohol, decyl alcohol, diethylene glycol, glycerin, polyethylene glycol, phenol, benzyl alcohol, or methyl benzyl alcohol; ketone groups such as acetone, methyl ethyl ketone, methyl butyl ketone, methyl isobutyl ketone, or diethyl ketone; ether groups such as methyl ethyl ether, diethyl ether, methyl butyl ether, methyl isobutyl ether, dimethyl ether, diisopropyl ether, or octyl phenyl ether; methyl acetate; ethyl acetate; ethyl oleate; ethyl acrylate; methyl methacrylate; dibutyl succinate; diethyl phthalate; diethyl tartrate; ethyl palmitate; and dioctyl phthalate. Among them, the use of an ether group or an ester group is preferable, and an ester group is particularly desirable.

Although there is no particular limitation, it is preferable that the content of water in the fixer fluid 34 constitutes 20% by weight or above of the fixer fluid 34 as a whole. More preferably, the water content falls in a range of from 20% to 95% by weight, particularly preferably, in a range of from 30% to 90% by weight. If the water content is less than 20% by weight, the permeability of the fixer fluid 34 is so low that, where the toner is high in amount, only the upper part of the toner is softened and/or swelled swiftly, and the softening and/or swelling actions are sluggish in the toner portion present on the contact surface with the recording medium 7. This leads to an undesirable decrease in the adherence strength between the toner and the recording medium 7. As a result, it is impossible to attain sufficiently high fixation strength. By way of contrast, if the water content is greater than 95% by weight, the fixer fluid 34 fails to exhibit high toner-softening and/or high toner-swelling effect, and it is thus impossible to attain sufficiently high fixation strength. On the other hand, although there is no particular limitation, it is preferable that the content of the toner fixing organic compound constitutes 80% by weight or below of the fixer fluid 34 as a whole. More preferably, the compound content falls in a range of from 5% to 80% by weight, particularly preferably, in a range of from 10% to 70% by weight.

In addition to water and the toner fixing organic compound, the fixer fluid 34 may be added with a surfactant which is capable of keeping the toner fixing organic compound in a dispersed state in water and of improving the wettability of the fixer fluid 34 with respect to the toner. The surfactant for use can be selected from among known substances, for example, salt of higher alcohol sulfuric ester such as lauryl sulfate ester sodium salt; higher fatty acid metal salt such as sodium oleate; a negative ion surfactant such as fatty acid derivative sulfuric ester salt or phosphoric ester; a positive ion surfactant such as quaternary ammonium salt or heterocyclic amine; an amphoteric ion surfactant such as amino acid ester or amino acid; a nonionic surfactant; polyoxyalkylene alkyl ether; and polyoxy ethylene alkyl amine.

Further, the fixer fluid 34 may be added with, as a dispersant, a coupling agent such as diethylene glycol; triethylene glycol; polyethylene glycol; monobutyl ether; or diethylene glycol monomethyl ether.

As a solvent used for the fixer fluid 34, a hydrofluoro ether group can be used instead of water, because it is also capable of softening and/or swelling the toner fixing organic compound. Specific examples thereof include: methyl nonafluoro butyl ether; methyl nonafluoro isobutyl ether; ethyl nonafluoro butyl ether; ethyl nonafluoro isobutyl ether; and 1,1,2,2-tetrafluoro ethyl-2,2,2-trifluoro ethyl ether. A hydrofluoro ether group can either be used alone or by way of a mixture of two or more kinds. Although there is no particular limitation, it is preferable that the content of a hydrofluoro ether group constitutes 50% to 99% by weight of the fixer fluid 34 as a whole. More preferably, the content falls in a range of from 50% to 95% by weight, particularly preferably, in a range of from 60% to 90% by weight. The remainder is the toner fixing organic compound.

In the fixing section 5, the droplets of the fixer fluid 34 ejected from the nozzle array 35 are applied to, of the entirety of the toner carrying surface of the recording medium 7 that is conveyed while being placed on the conveyance belt 30. At this time, the image portion receives the fixer fluid 34 of larger amount as compared with the non-image portion. In this way, the multi-color toner image present on the toner carrying surface of the recording medium 7 is fixed onto the recording medium 7, thereby producing a desired image. The recording medium 7 with the image formed thereon is ejected onto a discharge tray 39 disposed externally of the image forming apparatus 1, by means of an ejecting roller 38.

The recording medium supply section 6 includes a recording medium cassette 40, a pickup roller 41, and a pair of registration rollers 42*a* and 42*b*. The recording medium cassette 40 stocks the recording media 7. The pick-up roller 41 directs the recording media 7 to a conveyance path P one by one. The pair of registration rollers 42*a* and 42*b* feeds the recording media 7 to the pressure-contact portion between the secondary transfer roller 28 and the supporting roller 24 in synchronism with the conveyance of the multi-color toner image carried on the intermediate transfer belt 21 toward the pressure-contact portion between the secondary transfer roller 28 and the supporting roller 24.

In the recording medium supply section 6, the recording media 7 placed within the recording medium cassette 40 are directed to the conveyance path P one by one by means of the pick-up roller 41, and are then fed to the pressure-contact portion between the secondary transfer roller 28 and the supporting roller 24 by means of the registration rollers 42*a* and 42*b*.

On the whole, in the image forming apparatus 1, a multi-color toner image formed on the intermediate transfer belt 21 by the toner image forming section 2 is transferred onto the recording medium 7 at the pressure-contact portion between the secondary transfer roller 28 and the supporting roller 24. Then, the multi-color toner image, now held on the recording medium 7, receives droplets of the fixer fluid 34 ejected from the nozzle array 35, whereby the multi-color toner image is fixed onto the recording medium 7. In this way, a desired image is produced.

According to the present embodiment, the image portion on the toner carrying surface of the recording medium 7 receives the fixer fluid 34 of larger amount as compared with the non-image portion. In this way, not only the image portion but also the non-image portion undergoes contraction, in consequence whereof there results no great difference in degree of contraction between the image portion and the non-image portion. It is thus possible to prevent undesirable generation of wrinkles caused by the expansion and contraction that occur locally in the image portion.

Figure 5:
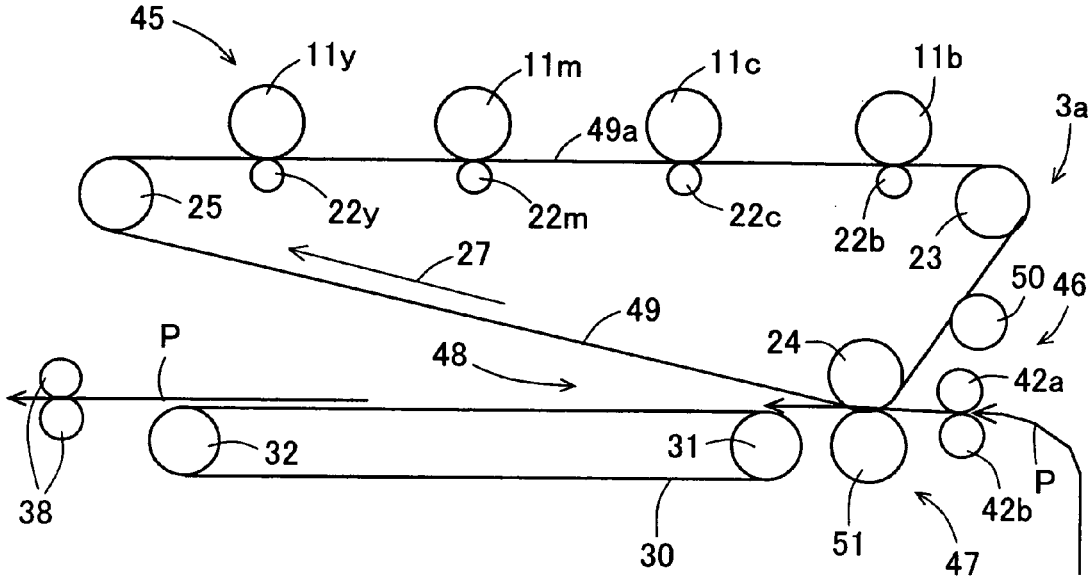
FIG. 5 is a side view schematically showing the constitution of the principal portion of an image forming apparatus according to a second non-limiting embodiment of the invention.
Figure 6:
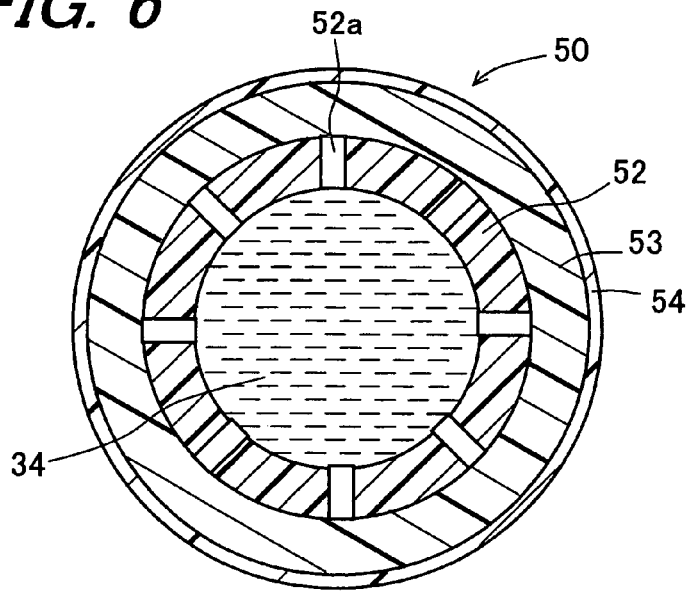
FIG. 6 is a sectional view schematically illustrating the constitution of a fixer fluid applying roller.

FIG. 5 is a side view schematically showing the constitution of the principal portion of an image forming apparatus 45 according to a second non-limiting example embodiment of the invention. FIG. 6 is a sectional view schematically showing the constitution of a fixer fluid applying roller 50.

The image forming apparatus 45 is analogous in constitution to the image forming apparatus 1, and especially its toner image forming section and recording medium supply section are identical with the toner image forming section 2 and the recording medium supply section 6 of the image forming apparatus 1, respectively. Therefore, neither graphic representation nor explanation thereof will be given below. Otherwise, the components that play the same or corresponding roles as in the image forming apparatus 1 will be denoted by the same reference numerals, and descriptions thereof will be omitted.

In the image forming apparatus 45, in advance of transferring a multi-color toner image carried on the intermediate transfer belt 49 onto the recording medium 7, the fixer fluid 34 is applied to the multi-color toner image. Moreover, the transference and the fixation of the multi-color toner image are achieved at the same time on the recording medium 7. In this construction, the toner image can be fixed onto the recording medium 7 with lesser fixer fluid 34 than that required in the case of applying the fixer fluid 34 to a toner image carried on the recording medium 7. Probably, this advantage can be gained because of the presence of the fixer fluid 34 which finds its way into the recording medium 7 without softening and/or swelling the toner.

More specifically, the image forming apparatus 45 includes the toner image forming section (only the photoreceptor drums 11*y*, 11*m*, 11*c*, and 11*b* are shown in the figure), intermediate transfer section 3*a*, a fixer fluid applying section 46, a transfer/fixing section 47 serving as the transfer section, an image transporting section 48, and the recording medium supply section (not shown).

The intermediate transfer section 3*a* of the image forming apparatus 45 has basically the same structure as the intermediate transfer section 3 of the image forming apparatus 1, the main difference being that an intermediate transfer belt 49 of the former and the intermediate transfer belt 21 of the latter are made of different materials.

The intermediate transfer belt 49 is constituted by laminating, on the surface of a 100 μm-thick polyimide film, a 500 μm-thick silicone rubber layer and a 20 μm-thick coating layer made of a fluorine resin composition in which PTFE and PFA are contained at a ratio of 8:2 (by weight) one after another. Note that the intermediate transfer belt 49 is not limited to the configuration described just above, for example, it may be constituted by forming a coating layer made of PTFE and/or PFA on a film made of polycarbonate, fluorine rubber, or the like material that exhibits electrical conductivity.

A toner carrying surface (the surface of the coating layer) 49*a* of the intermediate transfer belt 49 is formed of a fluorine resin composition whose adherability to toner is extremely low. Therefore, at the time of transferring and fixing a toner image onto the recording medium 7, substantially all of the amount of the toner constituting the toner image can be transfer-fixed onto the recording medium 7. Moreover, since the fluorine resin composition used to form the toner carrying surface 49*a* is impervious to the fixer fluid 34, it follows that the fixer fluid 34 to be applied, in its entirety, remains on the toner carrying surface 49*a* without impregnation. This makes it possible to soften and/or swell the toner constituting the toner image with a minimum necessary amount of the fixer fluid 34, and thereby reduce the amount of the fixer fluid 34 to be consumed.

It is preferable that the toner carrying surface 49*a* of the intermediate transfer belt 49 is leveled off insofar as possible. This is because the amount of adherent fixer fluid 34 varies with the degree of surface roughness of the toner carrying surface 49*a*. More specifically, the surface roughness of the toner carrying surface 49*a* is, on the basis of a center line average roughness (Ra), preferably set to be equal to or smaller than 1/5 of the volume average particle diameter of the toner, more preferably, 1/20 or below. Where the surface roughness is set to be equal to or smaller than 1/5 of the volume average particle diameter of the toner, the amount of the fixer fluid 34 to be applied to the non-image portion can be reduced to 10% by weight or below of the amount of the fixer fluid 34 to be applied to the image portion. On the other hand, where the surface roughness is set to be equal to or smaller than 1/20 of the volume average particle diameter of the toner, the amount of the fixer fluid 34 to be applied to the non-image portion can be reduced to 5% by weight or below of that to be applied to the image portion. Still further, even if the surface roughness is set at 1/100 of the volume average particle diameter of the toner, as the surface area is not null, the fixer fluid 34 can be applied to the non-image portion in an amount of approximately 1% of the amount to be applied to the image portion. However, with consideration given to the production cost of the intermediate transfer belt 49 and other factors, it is preferable that the surface roughness is set at 1/100 or above of the volume average particle diameter of the toner. Hence, the surface roughness of the toner carrying surface 49*a* is, on the basis of Ra, set to fall in a range of from 1/100 to 1/5, more preferably, in a range of from 1/100 to 1/20 of the volume average particle diameter of the toner. By doing so, the fixer fluid 34 of adequate amount can be applied to the non-image portion.

It is preferable that the contact angle of the toner carrying surface 49*a* with respect to the fixer fluid 34 is set at 80 degrees or below. If the contact angle exceeds 80 degrees, the fixer fluid 34 fails to adhere uniformly, and part of it is rejected to thereby form a large fluid droplet. This raises the possibility that generation of wrinkles or the like cannot be prevented from occurring in the recording medium 7. In the present embodiment, the contact angle of the toner carrying surface 49*a* is set at 70 degrees.

Moreover, since the intermediate transfer belt 49 has the elastically deformable silicone rubber layer formed thereon, it follows that the toner carrying surface 49*a* of the intermediate transfer belt 49 becomes deformed in conformity with the asperities of the surface of the recording medium 7. This makes it possible to transfer the toner image faithfully even onto the concavity-present part of the surface of the recording medium 7, and thereby produce a uniformly transfer-fixed image (visual image).

By virtue of the intermediate transfer belt 49, the fixer fluid 34 is applied via the intermediate transfer belt 49 to the recording medium 7, and thus the advantage is gained that the subsequently-explained fixer fluid applying roller 50 is free of adhesion of paper powder such as fibers constituting paper. For example, assumed is a case where a fixer fluid receiver is provided (not shown), the fixer fluid applying roller 50 rotates while being immersed in the fixer fluid 34 stored in the fixer fluid receiver, so that the fixer fluid 34 may be attached to the surface of the fixer fluid applying roller 50, and the amount of the fixer fluid 34 adherent to the surface of the fixer fluid applying roller 50 is adjusted by means of a removal blade. In this case, since no paper powder finds its way into the fixer fluid 34, it never occurs that the paper powder caught on the removal blade gives rise to lack of uniformity in the fixer fluid layer deposited on the fixer fluid applying roller 50. As a result, images of high quality can be obtained with stability for a longer period of time.

In the intermediate transfer section 3*a*, the toner images of different colors: yellow; magenta; cyan; and black formed by the toner image forming section (only the photoreceptor drums 11*y*, 11*m*, 11*c*, and 11*b* are shown in the figure) are superimposed one upon another on the toner carrying surface 49*a* of the intermediate transfer belt 49, thereby forming a multi-color toner image.

The fixer fluid applying section 46 mainly includes the fixer fluid applying roller 50 which is brought into pressure-contact with that part of the toner carrying surface 49*a* of the intermediate transfer belt 49 which is moved between the supporting rollers 23 and 24, and is rotatable by a driving section (not shown).

The fixer fluid applying roller 50 is a roller for applying the fixer fluid 34 to a toner image in an immediate contact manner, and serves as a coating member. The fixer fluid applying roller 50 includes a hollow core bar 52, an impregnation control layer 53 formed on an outer surface of the core bar 52, and a porous layer 54 formed on the outer surface of the impregnation control layer 53. The impregnation control layer 53 is made of an elastically deformable material which allows impregnation of the fixer fluid 34 and retention of the fixer fluid 34 in an impregnated state. Inside the shaft 52 is stored the fixer fluid 34. In order to feed the fixer fluid 34 into the permeation control layer 53, a plurality of fixer fluid supply holes 52*a* are disposed at predetermined spacings in the shaft 52. That is, the plurality of fixer fluid supply holes 52*a* is formed so as to penetrate from the outer surface to an inner wall surface of the shaft 52. The conditions to be fulfilled by the porous layer 54, such as a thickness, a pore ratio, and a material for use, can be changed as appropriate depending upon the composition of the fixer fluid 34 and other factors. In the present embodiment, the shaft 52 is 15 mm in outer diameter and 0.5 mm in wall thickness. The fixer fluid supply holes 52*a* are spaced 5 mm apart, each of which has a diameter of 0.1 mm. The permeation control layer 53 is designed as a 2 mm-thick layer made of foamed rubber having continuous bubbles. Instead of foamed rubber, a felt material is also usable. The porous layer 54 is a porous film formed of fluorine resin. In the present embodiment, as the porous layer 54, a PTFE porous film is used having a thickness of 50 μm and a pore ratio of 80%. A pore existing in the PTFE porous film has a diameter of 0.5 μm.

The porous layer 54 is the outermost layer of the fixer fluid applying roller 50. It is preferable that the contact angle of the porous layer 54 with respect to the fixer fluid 34 is set at 80 degrees or below. If the contact angle exceeds 80 degrees, the fixer fluid 34 fails to pass through the porous layer 54. This makes it impossible to apply the fixer fluid 34 to the toner image. In the present embodiment, the contact angle of the porous layer 54 with respect to the fixer fluid 34 is set at 60 degrees.

Moreover, it is preferable that the difference between the contact angle of the porous layer 54 with respect to the fixer fluid 34 and the contact angle of the intermediate transfer belt 49, more precise, the coating layer made of PTFE and PFA with respect to the fixer fluid 34. Specifically, by keeping the difference in contact angle as small as 20 degrees or below, it is possible to apply the fixer fluid 34 uniformly to the non-image portion on the toner carrying surface 49*a* of the intermediate transfer belt 49. Here, the value of the contact angle is measured, under the condition that the amount of measurement fluid is 2 μl, by means of a commercially available contact-angle measuring instrument (trade name: Automatic Contact Angle Meter CA-W) manufactured by Kyowa Interface Science Co., Ltd.

When replenishment of the fixer fluid 34 is necessary, for example, the fixer fluid applying roller 50 in itself is replaced with the new one in the form of a cartridge Alternatively, a fixer fluid storage tank may be arranged within the image forming apparatus 45 (not shown). In this case, the fixer fluid 34 is replenished from the fixer fluid storage tank.

In the fixer fluid applying roller 50, the fixer fluid 34 stored inside the shaft 52 flows into the permeation control layer 53 through the fixer fluid supply holes 52*a*. Then, the fixer fluid 34 passes through the permeation control layer 53 and the porous layer 54 successively to exude to the surface of the fixer fluid applying roller 50, and is eventually applied to the toner image.

In the fixer fluid applying section 46, the fixer fluid 34 is applied to the multi-color toner image formed on the toner carrying surface 49*a* of the intermediate transfer belt 49 by means of the fixer fluid applying roller 50 in a contact manner. In the present embodiment, the amount of the fixer fluid 34 to be applied to the image portion is given as about 5 g/m$^2$, whereas the amount of the fixer fluid 34 to be applied to the non-image portion is given as about 0.5 g/m$^2$. These values are about half those set for the case of applying the fixer fluid 34 to the toner image formed on the recording medium 7. Upon the application of the fixer fluid 34, the toner constituting the multi-color toner image is softened and/or swelled.

The transfer/fixing section 47 mainly includes a pressurizing roller 51 which is pressed against the supporting roller 24, with the intermediate transfer belt 49 lying therebetween, by a pressurizing section (not shown), and is rotatable by a driving section (not shown).

Used as the pressurizing roller 51 is a roller element composed of a shaft having an elastic layer and a surface layer formed successively around the outer periphery thereof. In the present embodiment, used as the pressurizing roller 51 is a roller element constituted by laminating, on the outer surface of a shaft, a 3 mm-thick elastic layer made of silicone rubber which has been hardened to 50 degrees in terms of the hardness in JIS-A and a 20 μm-thick surface layer made of PFA one after another. After all, the roller element is 28 mm in outer diameter. Moreover, the pressurizing roller 51 is brought into contact with the intermediate transfer belt 49 and the supporting roller 24 under a pressure force of 5 N/cm in terms of linear pressure. No voltage is applied to the pressurizing roller 51.

In the transfer/fixing section 47, the toner image constituted by the toner kept in a softened and/or swelled state through the application of the fixer fluid 34 is conveyed toward a pressure-contact portion between the pressurizing roller 51 and the supporting roller 24 while being carried on the toner carrying surface 49*a* of the intermediate transfer belt 49. In synchronism therewith, the recording medium 7 is fed from the recording medium supply section 6 to the same pressure-contact portion by way of the registration rollers 42*a* and 42*b*, thereupon the toner image and the recording medium 7 are laid to overlap each other under a pressure force. As a consequence, the toner image is transferred and fixed onto the recording medium 7. During the transfer-fixation process, when the toner image is pressed against the recording medium 7, the toner constituting the toner image is forced into the fibers constituting paper of the recording medium 7 and simultaneously the toner particles fuse with one another, thereby leveling off the surface of the toner image. In this way, by virtue of the subtractive color mixing process, it is possible to obtain a high-quality color image which is excellent in coloration and in surface glossiness.

The image transporting section 48 has basically the same structure as that of the fixing section 5 of the image forming apparatus 1, except that the fixer fluid applying section 33 is not included therein. Therefore, the components that play the same or corresponding roles as in the fixing section 5 will be denoted by the same reference numerals, and descriptions thereof will be omitted. In the image transporting section 48, the recording medium 7 with the image formed thereon by the transfer/fixing section 47 is conveyed while being placed on a conveyance belt 30, and is then ejected onto the discharge tray 39 disposed externally of the image forming apparatus 45, by means of an ejecting roller 38.

On the whole, in the image forming apparatus 45, by the fixer fluid applying section 46, the fixer fluid 34 is applied to a multi-color toner image formed on the intermediate transfer belt 49 by the toner image forming section 2, so that the toner constituting the multi-color toner image can be softened and/or swelled. Then, the multi-color toner image is transferred onto the recording medium 7 at the pressure-contact portion between the pressurizing roller 51 and the supporting roller 24, thereby forming a desired image. After that, by the image transporting section 48, the recording medium 7 with the image is ejected onto the discharge tray 39 disposed externally of the image forming apparatus 45.

According to the non-limiting example embodiment of the invention, used as the fixer fluid applying section 46 is the fixer fluid applying roller 50 which has, on its surface, at least the elastically deformable porous layer 54 for retaining the fixer fluid, and is rotatable about its axis. The fixer fluid applying roller 50 is rotated while being kept in pressure-contact with the toner carrying surface 49*a* of the intermediate transfer belt 49, and, in this state, the fixer fluid is applied to the toner carrying surface 49*a* in a contact manner. In this case, it never occurs that the fixer fluid retained in the porous layer 54 builds up at the entrance of the contact portion between the fixer fluid applying roller 50 and the intermediate transfer belt 49 that will eventually form a meniscus. As a result, while the fixer fluid is making contact with the toner image, the toner image is free from irregularities ascribable to the flow of the fixer fluid, which leads to production of an image of high quality and high resolution. Moreover, the porous layer 54 of the fixer fluid applying roller 50 has a multiplicity of fine pores capable of retaining the fixer fluid, and is also elastically deformable in conformity with the configuration of a target object on contact. Therefore, where the target object has a three-dimensional structure like the toner image present in the image portion, as the porous layer 54 becomes deformed, a large amount of the fixer fluid is caused to ooze out through the fine pores, which results in an increase in application amount of the fixer fluid per unit area. By way of contrast, where the target object has a flat surface like the non-image portion, the porous layer 54 of the fixer fluid applying roller 50 is less deformable, and thus only a small amount of the fixer fluid is caused to ooze out through the fine pores. Moreover, an excess amount of the fixer fluid is absorbed through the fine pores under a capillary phenomenon, which results in a decrease in application amount of the fixer fluid per unit area. In this way, the application amount of the fixer fluid per unit area can be so controlled that the application amount varies between the image portion and the non-image portion.

Figure 7:
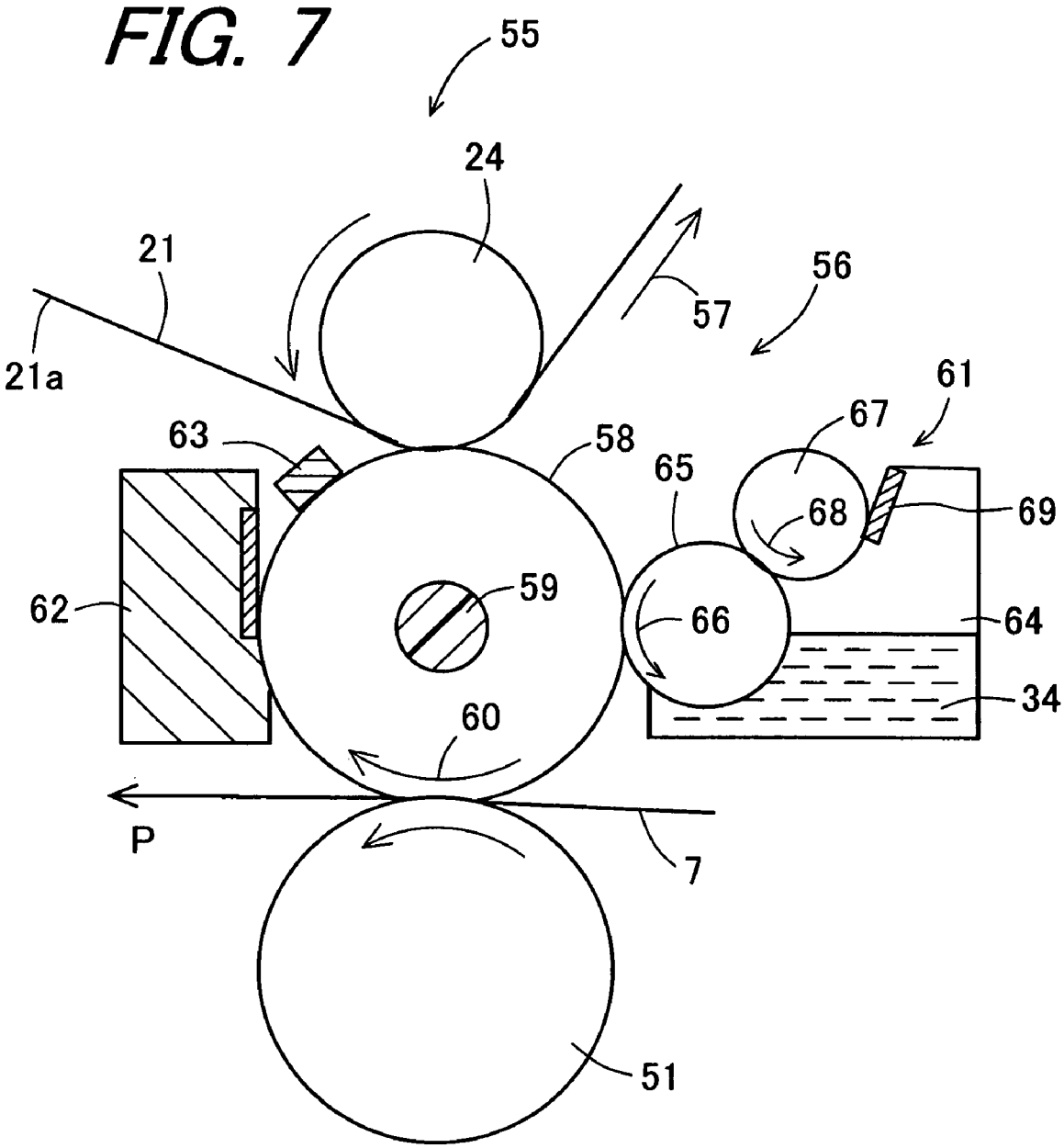
FIG. 7 is a side view schematically showing the constitution of the principal portion of an image forming apparatus according to a third non-limiting embodiment of the invention.

FIG. 7 is a side view schematically showing the constitution of the principal portion of an image forming apparatus 55 according to a third non-limiting example embodiment of the invention.

The image forming apparatus 55 is analogous in constitution to the image forming apparatuses 1 and 45. Therefore, the components that play the same or corresponding roles as in the image forming apparatuses 1 and 45 will be denoted by the same reference numerals, and descriptions thereof will be omitted. Neither graphic representation nor explanation will be given as to the identical components.

In the image forming apparatus 55, a multi-color toner image formed on the toner carrying surface 21*a* of the intermediate transfer belt 21 is transferred onto a transfer/fixing roller 58 serving as an intermediate transfer medium, and is then heated thereon. The fixer fluid 34 is applied to the multi-color toner image in a heated state in a contact manner to soften and/or swell the toner. After that, the multi-color toner image is transferred and simultaneously fixed onto the recording medium 7, thereby producing a desired image.

The image forming apparatus 55 includes a toner image forming section, the intermediate transfer section (only the intermediate transfer belt 21 and the supporting roller 24 are shown in the figure), a transfer/fixing section 56, a image transporting section (not shown), and a recording medium supply section (not shown).

The toner image forming section is analogous in constitution to the toner image forming section 2 of the image forming apparatus 1. However, the intermediate transfer belt 21 runs in the direction indicated by an arrow 57; that is, the running direction thereof is the reverse of that of the intermediate transfer belt 21 of the image forming apparatus 1. Correspondingly, from the upstream side along the direction indicated by the arrow 57, the image forming units 10*y*, 10*m*, 10*c*, and 10*b* are arranged in turn. The components of each of the image forming units are rotatable in the reverse direction accordingly. That is, the image forming units 10*y*, 10*m*, 10*c*, and 10*b* are opposite in placement order to those of the image forming apparatus 1.

The intermediate transfer section is also analogous in constitution to the intermediate transfer section 3 of the image forming apparatus 1. However, as described just above, since the intermediate transfer belt 21 runs in the reverse direction indicated by the arrow 57, it follows that the belt cleaner 26 is located beside the supporting roller 23, instead of the supporting roller 25. At this position, the belt cleaner 26 is brought into abutment with the toner carrying surface 21*a* of the intermediate transfer belt 21.

The transfer/fixing section 56 includes the transfer/fixing roller 58, a fixer fluid applying section 61, a pressurizing roller 51, a cleaning section 62, and a temperature sensor 63. The transfer/fixing roller 58 has a heating section 59 in its inside, and is rotatable in the direction indicated by an arrow 60 by a driving section (not shown). The fixer fluid applying section 61 applies the fixer fluid 34 to the transfer/fixing roller 58. The fixer fluid applying section 61, the pressurizing roller 51, the cleaning section 62, and the temperature sensor 63 are arranged around the transfer/fixing roller 58 in the order named, from the upstream side along the direction in which the transfer/fixing roller 58 is rotatable. Note that, on the downstream side of the temperature sensor 63 along the rotation direction of the transfer/fixing roller 58, the transfer/fixing roller 58 is brought into pressure-contact with the supporting roller 24, with the intermediate transfer belt 21 lying therebetween.

Used as the transfer/fixing roller 58 is a roller element composed of a metal-made shaft having an elastic layer and a surface layer formed successively around the outer periphery thereof. In the present embodiment, used as the transfer/fixing roller 58 is a roller element composed of a shaft made of 1 mm-thick carbon steel, a 3 mm-thick elastic layer and a 20 μm-thick surface layer made of PFA which are formed on an outer surface of the shaft one after another. The elastic layer is made of silicone rubber, the volume resistance of which is adjusted to fall in a range of from $10^8$ to $10^9$ Ω·cm. After all, the roller element is 30 mm in outer diameter. To the transfer/fixing roller 58 is applied a voltage of a polarity reverse to the potential of the charged toner, for example, a voltage of +1 kV, whereby the toner is electrostatically attracted so that transference is effected. As the heating section 59 disposed inside the transfer/fixing roller 58, for example, a heater formed of a halogen lamp is used. The heating section 59 generates heat, in response to a signal coming from the temperature sensor 63 for detecting the surface temperature of the transfer/fixing roller 58, in such a way that the temperature is uniform throughout the entire surface of the transfer/fixing roller 58.

By the action of the transfer/fixing roller 58, the toner image that is an aggregate of toner particles is heated to a temperature such that disappearance of the spaces among the toner particles due to toner particle fusion is not caused. More specifically, the heating temperature is preferably a temperature that is equal to or higher than the glass transition temperature of the binder resin contained in the toner particle and lower than the softening point of the binder resin, more desirably, in a range of from 50 to 130° C. This allows, when the fixer fluid 34 is applied to the toner image in a subsequent process step, the fixer fluid 34 to find its way into the toner image successfully, and thereby allows the toner constituting the whole toner image to soften and/or swell. Hence, the adherability between the toner image and the recording medium 7 can be enhanced even further. Note that, where the toner contains, in addition to the binder resin, a wax material which is lower in softening point than the binder resin, the heating temperature of the toner is preferably a temperature that falls in a range of from the softening point of the wax to the softening point of the binder resin, more preferably, in a range of from the softening point of the wax to the glass transition temperature of the binder resin. More desirably, the heating temperature is a temperature close to the softening point of the wax. In this regard, although there is no particular limitation, the variation of the heating temperature from the softening point of the wax should preferably be kept within ±10° C., more preferably, ±5° C.

While the surface temperature of the transfer/fixing roller 58 is variable in accordance with the types of binder resin and wax materials to be contained in the toner, from an energy-saving standpoint, it is preferable to keep the surface temperature as low as possible, for example, 100° C. or below. By setting the surface temperature at 100° C. or below, it is possible to reduce the loss of thermal energy ascribable to heat dissipation. Moreover, upon setting the image forming apparatus 55 in motion, a temperature rise can be achieved at a lower energy expenditure, and also the temperature reaches a predetermined level in a short time, which permits a reduction in warm-up time. In the end, no heat-retaining operation is necessary during standby, and therefore energy saving of the entire apparatus can be realized. In addition, there have been known quite a few binder resin materials having a glass transition temperature and/or a softening point of 100° C. or below, as well as wax materials having a softening point of 100° C. or below. Among them, suitable materials can be selected arbitrarily for toner production.

In the present embodiment, the toner in use contains polyester having a glass transition temperature of 60° C. as a binder resin. It is thus preferable that the heater acting as the heating section 59 is so controlled that the surface temperature of the transfer/fixing roller 58 is kept at approximately 68° C. On the other hand, where the toner in use contains polyester in which a wax having a softening point of 70° C. is dispersed, the heating section 59 is preferably so controlled that the surface temperature of the transfer/fixing roller 58 is kept at approximately 80° C.

A transference electric field is applied between the transfer/fixing roller 58 and the intermediate transfer belt 21 by the voltage applying section (not shown), and thereby the toner image formed on the toner carrying surface 21*a* of the intermediate transfer belt 21 is electrostatically transferred onto the transfer/fixing roller 58. The toner image transferred onto the transfer/fixing roller 58 is heated by the heating section 59 disposed inside the transfer/fixing roller 58, and is then subjected to the application of the fixer fluid 34 at a next process step.

The fixer fluid applying section 61 includes a fixer fluid receiver 64, a fixer fluid applying roller 65, a regulating roller 67, and removal blade 69. The fixer fluid receiver 64 stores therein the fixer fluid 34. The fixer fluid applying roller 65 is brought into pressure-contact with the transfer/fixing roller 58, and is rotatable in the direction indicated by an arrow 66 by a driving section (not shown). Part of the fixer fluid applying roller 65 is immersed in the fixer fluid 34 stored in the fixer fluid receiver 64. The regulating roller 67 is brought into pressure-contact with the surface of the fixer fluid applying roller 65, and is rotatable in the direction indicated by an arrow 68 by a driving section (not shown). The regulating roller 67 regulates the amount of the fixer fluid 34 adherent to the surface of the fixer fluid applying roller 65 as appropriate. The removal blade 69 has its one end secured to the fixer fluid receiver 64 and has its other end brought into pressure-contact with the surface of the regulating roller 67. The removal blade 69 removes the fixer fluid 34 remaining on the surface of the regulating roller 67. Note that the fixer fluid applying roller 65 and the regulating roller 67 are driven e.g. by a single gear train to rotate at a predetermined circumferential velocity ratio.

In response to fixer-fluid 34 consumption conditions, the fixer fluid receiver 64 is replenished with the fixer fluid 34, through a fixer fluid storage tank (not shown), until the fixer fluid 34 reaches a predetermined level.

Used as the fixer fluid applying roller 65 is a roller element composed of a metal-made shaft having an elastic layer and a hydrophilic-treated porous layer which are formed on an outer surface of the shaft one after another. However, the fixer fluid applying roller 65 is not limited thereto, for example, it is possible to use a roller element composed of a metal-made shaft having, on its surface, a coating layer made of a material which possesses elasticity and lyophilicity. Specific examples of such a material include: metal such as aluminum; hydrophilic resin; and rubber materials such as EPDM. These lyophilic materials exhibit a high affinity for the fixer fluid 34, and therefore its use makes it possible to retain the fixer fluid 34, in the form of a thin layer, on the surface of the fixer fluid applying roller 65. This makes it possible to apply a small amount of the fixer fluid 34 over as wide an area as possible, and thereby reduce the amount of the fixer fluid 34 to be consumed. As another advantage, it never occurs that an excess amount of the fixer fluid 34 is attached to the toner image that will eventually sweep the toner away. This helps protect the toner image from irregularities. In the present embodiment, used as the roller element is a roller element composed of a shaft having a diameter of 12 mm, a 4 mm-thick elastic layer made of elastic silicone rubber laminated on the outer surface of the shaft (as of this point, the roller element is 20 mm in outer diameter), and a 10 μm-thick, hydrophilic-treated porous layer made of porous PTFE laminated on the elastic layer Moreover, in the present embodiment, the pressure force of the fixer fluid applying roller 65 against the transfer/fixing roller 58 is a pressure force such as to allow passage of the fixer fluid carried on the surface of the fixer fluid applying roller 65 through a contact portion, namely, a nip portion between the fixer fluid applying roller 65 and the transfer/fixing roller 58, in a state where the fixer fluid applying roller 65 carrying a thin layer of the fixer fluid on its surface is rotated while being kept in pressure-contact with the transfer/fixing roller 58. That is, the pressure force is set to a linear pressure falling in a range of from 0.05 N/cm to 1.0 N/cm, preferably, 0.5 N/cm. Further, in the present embodiment, the fixer fluid applying roller 65 is rotatably driven at a velocity equivalent to the rotation speed of the intermediate transfer belt 21.

As the regulating roller 67, for example, a metal-made roller element is used. In the present embodiment, as the regulating roller 67, a roller element made of stainless steel having an outer diameter of 12 mm is used. Moreover, in the present embodiment, the regulating roller 67 is rotated, at a circumferential velocity which is ½ of that of the fixer fluid applying roller 65, in a direction such that its surface travels reversely to the surface of the fixer fluid applying roller 65 at a pressure-contact portion therebetween, namely, in the direction indicated by the arrow 68.

As the removal blade 69, for example, a metal-made platy element is used. In the present embodiment, a plate made of stainless steel having a thickness of 40 mm is used. The removal blade 69 has its front end brought into pressure-contact with the surface of the regulating roller 67, for removing the fixer fluid 34 adherent to the surface of the regulating roller 67.

In the fixer fluid applying section 61, at the outset, the fixer fluid applying roller 65 is rotated while being immersed in the fixer fluid 34 stored in the fixer fluid receiver 64, and thereby the fixer fluid 34 is attached to the surface of the fixer fluid applying roller 65. Next, the fixer fluid 34 is shaped into a thin layer having a substantially uniform thickness by the regulating roller 67, and is then applied to the toner image formed on the transfer/fixing roller 58 at the pressure-contact portion between the fixer fluid applying roller 65 and the transfer/fixing roller 58. Then, the toner image is heated from one side contacting the surface of the transfer/fixing roller 58, and receives the fixer fluid 34 from the outside of the transfer/fixing roller 58. That is, the toner constituting the toner image is softened and/or swelled in a heated state. Meanwhile, the residual fixer fluid 34 remaining on the surface of the regulating roller 67 is removed by the removal blade 69.

In this way, the present embodiment is characterized in that the fixer fluid 34 is applied to the toner image on a toner carrier which is another intermediate transfer medium different from the intermediate transfer belt 21, namely, the transfer/fixing roller 58. This results in the advantage that the intermediate transfer belt 21 is less prone to adhesion of the fixer fluid 34. As another advantage, since the toner image is heated not on the intermediate transfer belt 21 but on the transfer/fixing roller 58, it follows that the temperature of the intermediate transfer belt 21 can be inhibited from rising sharply. This makes it possible to prevent occurrence of an undesirable temperature rise in the components of the toner image forming section, as well as degradation of toner quality ascribable to the application of the fixer fluid 34 during a toner-image formation process. As a result, images of high quality can be obtained with stability for a longer period of time.

Moreover, in the present embodiment, the toner image is heated from one side contacting the surface of the transfer/fixing roller 58, and receives the fixer fluid 34 from another side facing the surface of the fixer fluid applying roller 65. This makes it possible to soften and/or swell the toner constituting the toner image to an extent that would provide sufficient adherability with respect to the recording medium 7, and thereby obtain an image fixed to the recording medium 7 with high fixation strength. Indeed, the application of heat allows that part of the toner image which contacts with the transfer/fixing roller 58 to soften and/or swell satisfactorily. However, since most of the toner is composed of a binder resin which is low in thermal conductivity, it follows that a temperature rise is sluggish in the outermost part of the toner image, and therefore the toner in the outermost part fails to soften and/or swell satisfactorily. This leads to poor adherability with respect to the recording medium 7. In view of the foregoing, the toner constituting the toner image receives the fixer fluid 34 from the outside thereof. This allows the toner constituting the whole toner image to soften and/or swell satisfactorily, and thereby enhances the adherability of the toner image with respect to the recording medium 7. As a result, even if the recording medium 7 with the fixed image is bent, the fixed image is prevented from coming off with high fixation strength.

The pressurizing roller 51 is brought into pressure-contact with the transfer/fixing roller 58 under a linear pressure of 10 N/cm. The toner image formed on the transfer/fixing roller 58 and constituted by the toner which is in a softened and/or swelled state through the application of heat and the fixer fluid 34, is conveyed to the pressure-contact portion between the pressurizing roller 51 and the transfer/fixing roller 58. In synchronism therewith, the recording medium 7 is fed from the recording medium supply section (not shown) to the pressure-contact portion, thereupon the toner image is transferred and fixed onto the recording medium 7 under a pressure force exerted by the pressurizing roller 51. In this way, a desired image is produced.

The cleaning section 62 removes the residual toner, the fixer fluid 34, paper powder, etc. present on the surface of the transfer/fixing roller 58 after the toner image is transferred onto the recording medium 7 and makes cleaning of the transfer/fixing roller 58.

The temperature sensor 63 detects the surface temperature of the transfer/fixing roller 58. The detected information is transmitted, as a signal, to the heating section 59 disposed inside the transfer/fixing roller 58.

In the transfer/fixing section 56, the toner image formed on the intermediate transfer belt 21 is transferred onto the transfer/fixing roller 58. Then, the fixer fluid 34 is applied to the toner image kept in a heated state on the transfer/fixing roller 58 to soften and/or swell the toner. After that, the toner image is transferred and fixed onto the recording medium 7, thereby forming a desired image.

The image transporting section of this embodiment is identical with the image transporting section 48 of the image forming apparatus 45. The recording medium supply section of this embodiment is identical with the recording medium supply section 6 of the image forming apparatus 1.

According to the present embodiment, used as the intermediate transfer medium is the transfer/fixing roller 58 having a smooth surface that is rotatable about its axis. The fixer fluid applying section 61 is provided with the fixer fluid applying roller 65 which has an elastic layer formed on the surface thereof, and is rotatable about its axis. Moreover, The fixer fluid applying roller 65 is brought into pressure-contact with transfer/fixing roller 58. A thin layer of the fixer fluid is formed on the surface of the fixer fluid applying roller 65. Then, a pressure force such as to allow passage of the fixer fluid through a contact portion (nip portion) between the fixer fluid applying roller 65 and the fixer fluid applying roller 65, is exerted on the fixer fluid applying roller 65. This enables the thin layer of the fixer fluid formed on the surface of the fixer fluid applying roller 65 to pass smoothly through the contact portion between the fixer fluid applying roller 65 and the transfer/fixing roller 58. In this case, it never occurs that the fixer fluid builds up at the entrance of the contact portion that will eventually form a large meniscus. As a result, the fixer fluid applying roller 65 is brought into pressure-contact with the transfer/fixing roller 58, with the fixer fluid layer lying therebetween. Moreover, while the fixer fluid is making contact with the toner image, the fixer fluid is inhibited from flowing greatly, and the toner image is free from irregularities accordingly. This makes possible production of an image of high quality and high resolution. Further, being made of an elastic material, the surface of the fixer fluid applying roller 65 becomes deformed in conformity with the asperities of the toner image. Therefore, in the toner image-present portion, the fixer fluid applying roller 65 is brought into pressure-contact with the toner image through the fixer fluid layer. In this way, on the toner carrying surface of the transfer/fixing roller 58, even if the toner amount varies from part to part, the fixer fluid can be applied uniformly. For example, even if the toner amount varies greatly from part to part for a case where, for example, a multi-color toner image is formed, the multi-color toner image can be fixed uniformly without fail. This makes production of a high-quality image possible. Moreover, since the transfer/fixing roller 58 has a smooth surface and the fixer fluid applying roller 65 has an elastic layer formed on the surface thereof, it follows that the image portion in which the toner image that is an aggregate of toner particles (porous body) is formed receives the fixer fluid in a larger amount, whereas the non-image portion in which the toner is not carried on the toner carrying surface receives the fixer fluid in a smaller amount. That is, by utilizing the transfer/fixing roller 58 having a smooth surface and the fixer fluid applying roller 65 having an elastic layer formed on its surface in combination, and also by exerting, on the fixer fluid applying roller 65, a pressure force such as to allow passage of the fixer fluid layer formed on the surface of the fixer fluid applying roller 65 through the contact portion between the fixer fluid applying roller 65 and the transfer/fixing roller 58, it is possible to control the application amount of the fixer fluid per unit area, and thereby apply the fixer fluid to the image portion and the non-image portion separately in different amounts.

Figure 8:
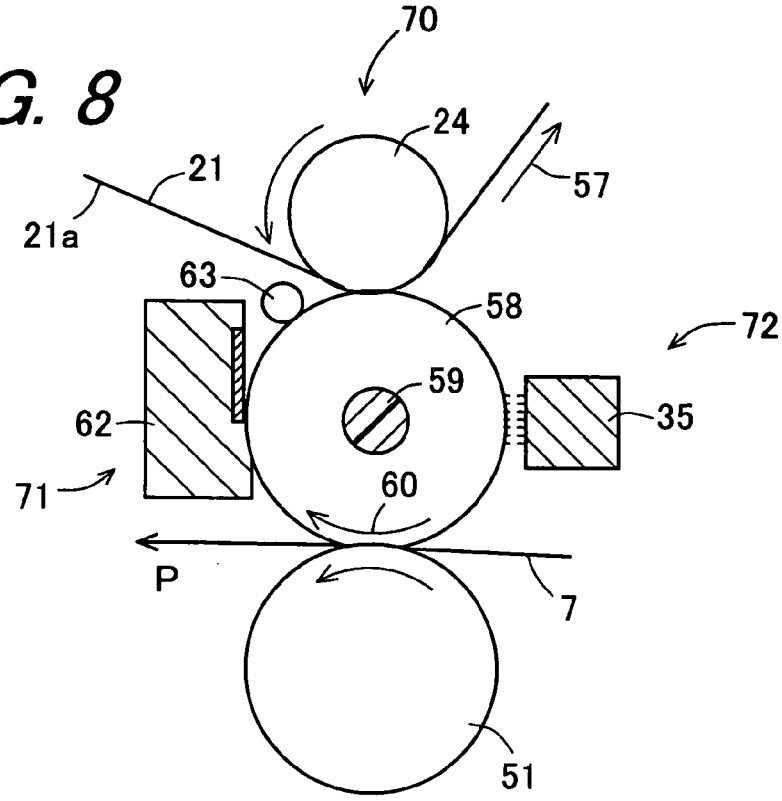
FIG. 8 is a sectional view schematically illustrating the constitution of the principal portion of an image forming apparatus according to a fourth non-limiting embodiment of the invention.

FIG. 8 is a sectional view schematically showing the constitution of the principal portion of an image forming apparatus 70 according to a fourth non-limiting example embodiment of the invention.

The image forming apparatus 70 is analogous in constitution to the image forming apparatus 55. Therefore, the components that play the same or corresponding roles as in the image forming apparatus 55 will be denoted by the same reference numerals, and descriptions thereof will be omitted. Neither graphic representation nor explanation will be given as to the identical components.

In the image forming apparatus 70, a toner image formed on the intermediate transfer belt 21 is transferred onto the transfer/fixing roller 58, and is then heated by the heating section 59 disposed inside the transfer/fixing roller 58. The fixer fluid 34 is applied to the toner image in a heated state by means of the nozzle array 35 acting as a fixer fluid applying section 72.

In the image forming apparatus 70, a transfer/fixing section 71 thereof includes the transfer/fixing roller 58 having the heating section 59 in its inside, the fixer fluid applying section 72, the pressurizing roller 51, the cleaning section 62, and the temperature sensor 63. Among them, the fixer fluid applying section 72, the pressurizing roller 51, the cleaning section 62, and the temperature sensor 63 are arranged around the transfer/fixing roller 58 in the order named, from the upstream side along the direction in which the transfer/fixing roller 58 is rotatable.

The fixer fluid applying section 72 is mainly composed of the nozzle array 35. The nozzle array 35 is identical with the nozzle array 35 of the image forming apparatus 1. That is, the nozzle array 35 is composed of a plurality of minute nozzles arranged in an array (not shown) for jetting microscopic droplets of the fixer fluid 34 toward the toner carrying surface of the recording medium 7 in response to an electric control signal. The pitch at which the minute nozzles are arranged is determined in such a way that the microscopic droplets of the fixer fluid 34 ejected from the minute nozzles cover, of the entirety of the toner carrying surface of the recording medium 7 to perfection. Moreover, in the nozzle array 35, the diameter of the microscopic droplet can be changed suitably. By controlling the droplet diameter properly, it is possible to adjust the density of the number of fluid droplets to be applied (dot number). For example, the amount of the fixer fluid 34 to be applied can be controlled in a range of from 1 $g/m^2$ to 10 $g/m^2$. More specifically, given that the fixer fluid 34 adjusted to a density of 1 $g/m^2$ is applied to an image portion, namely a toner image-present portion of the image-forming region at a droplet diameter of 20 μm and at a pitch of 30 μm, then the application amount (coverage amount) is given as 4.7 $g/m^2$. Moreover, given that the fixer fluid 34 adjusted to the same density is applied at a droplet diameter of 45 μm and at a pitch of 100 μm, then the application amount (coverage amount) is given as 4.8 $g/m^2$.

For example, the nozzle array 35 is designed based on a piezo system employing a piezoelectric element for use in an ink-jet type printer.

By virtue of such a nozzle array 35, in response to image signals, the fixer fluid 34 can be applied to the image portion and the non-image portion separately in different amounts. In the present embodiment, the amount of the fixer fluid 34 to be applied to the image portion is given as 5 $g/m^2$, whereas the amount of the fixer fluid 34 to be applied to the non-image portion is given as 0.5 $g/m^2$. While the amount of the fixer fluid 34 to be applied to the non-image portion is made uniform, just as is the case with the nozzle array 35 of the image forming apparatus 1, it is possible to vary the amount of the fixer fluid 34 to be applied to the non-image portion according to the distance with respect to the image portion.

In the fixer fluid applying section 72, the nozzle array 35 spits microscopic droplets of the fixer fluid 34 toward the toner image kept in a heated state on the surface of the transfer/fixing roller 58. In this way, the fixer fluid 34 is applied to the toner image.

In the transfer/fixing section 71, the toner image formed on the intermediate transfer belt 21 is transferred onto the transfer/fixing roller 58. Then, the fixer fluid 34 is applied to the toner image kept in a heated state on the transfer/fixing roller 58 to soften and/or swell the toner. After that, the toner image is transferred and fixed onto the recording medium 7, thereby forming a desired image.

Figure 9:
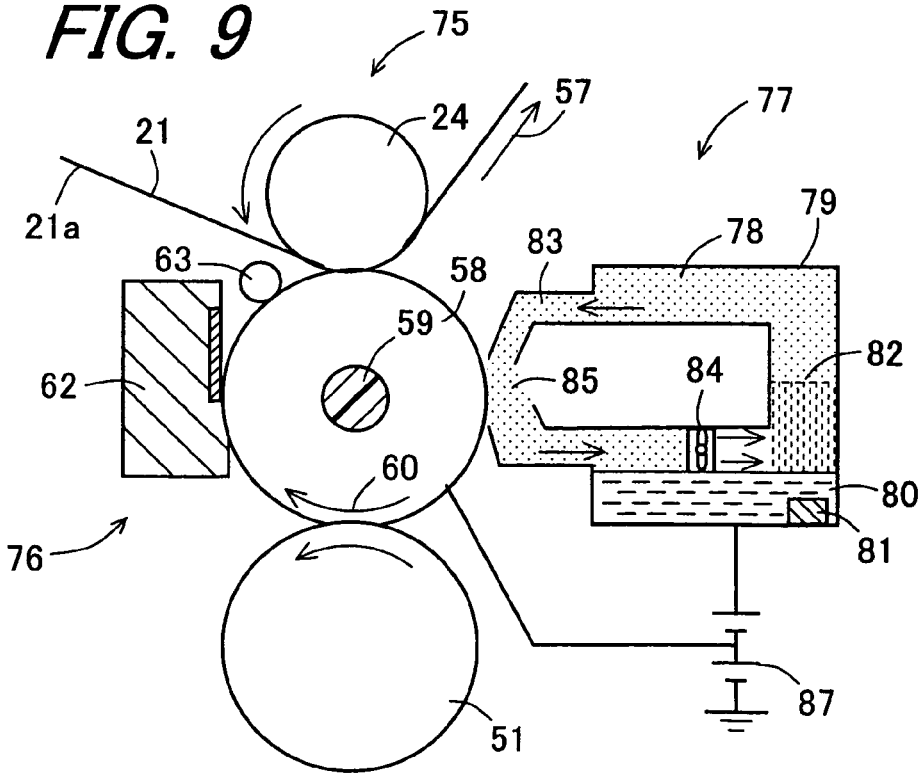
FIG. 9 is a sectional view schematically showing the constitution of the principal portion of an image forming apparatus according to a fifth non-limiting embodiment of the invention.

FIG. 9 is a sectional view schematically showing the constitution of the principal portion of an image forming apparatus 75 according to a fifth non-limiting example embodiment of the invention.

The image forming apparatus 75 is analogous in constitution to the image forming apparatus 55. Therefore, the components that play the same or corresponding roles as in the image forming apparatus 55 will be denoted by the same reference numerals, and descriptions thereof will be omitted. Neither graphic representation nor explanation will be given as to the identical components.

In the image forming apparatus 75, a toner image formed on the intermediate transfer belt 21 is transferred onto the transfer/fixing roller 58, and is then heated by the heating section 59 disposed inside the transfer/fixing roller 58. The fixer fluid 34 is applied to the toner image in a heated state by means of a fixer fluid atomization unit 78 acting as a fixer fluid applying section 77.

In the image forming apparatus 75, a transfer/fixing section 76 thereof includes the transfer/fixing roller 58 having the heating section 59 in its inside, the fixer fluid applying section 77, the pressurizing roller 51, the cleaning section 62, and the temperature sensor 63. Among them, the fixer fluid applying section 77, the pressurizing roller 51, the cleaning section 62, and the temperature sensor 63 are arranged around the transfer/fixing roller 58 in the order named, from the upstream side along the direction in which the transfer/fixing roller 58 is rotatable.

The fixer fluid applying section 77 is mainly composed of the fixer fluid atomization unit 78. The fixer fluid atomization unit 78 includes a fixer fluid atomization unit main body 79, a fixer fluid storage portion 80, an ultrasonic transducer 81, a mesh 82, a spray duct 83, a fan 84, and a power source 87. The fixer fluid atomization unit main body 79 is made of an electrically conductive material. The fixer fluid storage portion 80 is disposed in the lower part of the fixer fluid atomization unit main body 79, and stores therein the fixer fluid 34. The ultrasonic transducer 81 is disposed in the fixer fluid storage portion 80 so as to make contact with or to be immersed in the fixer fluid 34. The mesh 82 turns the fixer fluid 34 into fine liquid mist. The spray duct 83 connects between an inlet port and an outlet port of the fixer fluid atomization unit main body 79, has an opening 85 facing the transfer/fixing roller 58, and refluxes the misty droplets of the fixer fluid 34 therethrough. The fan 84 produces a current of air on which the misty droplets of the fixer fluid 34 ride in the spray duct 83. The power source 87 applies a voltage to the fixer fluid atomization unit main body 79. The misty droplets of the fixer fluid 34 is discharged from the opening 85 to the outside. In addition, though not shown in the figure, yet a corona charger and a fan may be disposed in the vicinity of the opening portion 85 communicating with the inner space 86. This helps facilitate the discharge of the misty droplets of the fixer fluid 34 through the opening portion 85. Herein, the ultrasonic transducer 81 and the mesh 82 constitute an atomizer section. The fixer fluid atomization unit main body 79 and the power source 87 constitute a charging section and a transporting section.

In the fixer fluid atomization unit 78, a radio-frequency wave (in the present embodiment, a high-frequency wave of 2.4 MHz) is applied to the fixer fluid 34 stored in the fixer fluid storage portion 80 by means of the ultrasonic transducer 81. A resultant oscillation forces the fixer fluid 34 to fly, in the form of droplets of a size of about 3 μm, into the fixer fluid atomization unit main body 79. Some of the fluid droplets have a diameter as large as 1 mm or above. These fluid droplets are directed to the mesh 82 (in the present embodiment, a 0.5 mm-pitch stainless steel mesh) by the fan 84. When passing through the mesh 82, the fluid droplets are turned into fine liquid mist. The misty droplets reflux within the spray duct 83 while riding on an air current produced by the fan 84, and eventually come near the opening 85. At this time, the power source 87 is actuated to apply a voltage of predetermined level to the fixer fluid atomization unit main body 79 so as to cause a potential difference between the fixer fluid atomization unit main body 79 and the transfer/fixing roller 58, with the result that the misty droplets are positively charged; that is, the misty droplets are reverse in polarity to the charged toner image formed on the transfer/fixing roller 58. In the present embodiment, the voltage application is carried out so as to cause a potential difference of +50 V. In this way, since the misty droplets are charged reversely to the toner image, and also there is a potential difference of +50 V between the opening 85 and the transfer/fixing roller 58, it follows that the misty droplets are loaded with an electric field force that allows them to fly through the opening 85 toward the transfer/fixing roller 58. As a result, the misty droplets are attached to the toner carrying surface of the transfer/fixing roller 58 on which the toner image is placed. In the present embodiment, the fixer fluid 34 is applied to the non-image portion on the transfer/fixing roller 58 at 1 g/m$^2$. Note that the amount of the fixer fluid 34 to be applied to the non-image portion can be controlled by adjusting the difference in potential between the transfer/fixing roller 58 and the fixer fluid atomization unit 78. It is also possible to adjust the potential difference as appropriate in accordance with the properties of the recording medium 7 such as a thickness or water absorbability.

In the meantime, the toner constituting the toner image is negatively charged and thus attracts the positively-charged misty droplets. Therefore, the image portion in which the toner image is present receives the fixer fluid 34 of larger amount as compared with the non-image portion. This makes it possible to prevent generation of wrinkles in the recording medium 7, as well as to reduce the amount of the fixer fluid 34 to be used.

It is preferable that the diameter of a misty droplet of the fixer fluid 34 is set to be 5 times or less as small as the volume average particle diameter of the toner. In this case, at the instant when the misty droplets of the fixer fluid 34 are attached to the toner image, the toner image can be prevented from suffering irregularities due to the flow or agglomeration of toner particle. Moreover, by setting the droplet diameter at a small value, it is possible to change a traveling direction of the fluid droplets as appropriate under an electric field force or electric charge. The droplet diameter can be adjusted by changing, for example, high-frequency output delivered by the ultrasonic transducer 81 and the pitch of the mesh 82.

In the transfer/fixing section 76, the toner image formed on the intermediate transfer belt 21 is transferred onto the transfer/fixing roller 58. Then, the fixer fluid 34 in the form of misty droplets is applied to the toner image kept in a heated state on the transfer/fixing roller 58 to soften and/or swell the toner. After that, the toner image is transferred and fixed onto the recording medium 7, thereby forming a desired image.

Although, in the present embodiment, the misty droplets of the fixer fluid 34 are applied to the toner image kept in a heated state on the transfer/fixing roller 58, the invention is not limited thereto. For example, the misty droplets of the fixer fluid 34 may also be applied to the toner image formed on the recording medium 7.

Although, in the present embodiment, the ultrasonic transducer 81 is used to atomize the fixer fluid 34, the invention is not limited thereto. Therefore, any other known atomization technique may be adopted instead, for example, a method for atomizing the fixer fluid 34 by means of a high-velocity gas flow such as airflow.

Although, in the image forming apparatus embodying the invention, such a fixer fluid 34 as described hereinabove is used to soften and/or swell the toner, the invention is not limited thereto. Instead, a fixer solution containing a known bonding or adhesive ingredient may be used. Specific examples of such an ingredient include: a rubber-base adhesive predominantly composed of polymeric elastomer such as chloroprene rubber, nitrile rubber, or SBR rubber; and an emulsion adhesive prepared by dispersing, in water, hydrophilic synthetic resin such as vinyl acetate, ethylene-vinyl acetate copolymer (EVA), or acrylic resin. In this case, not only the toner-softening and/or toner-swelling effect, but also an adhesive power exerted by the bonding or adhesive ingredient contributes to the adherability between the toner and the recording medium 7. This makes it possible to attain enhanced adherability, and thus the toner image can be fixed onto the recording medium 7 with sufficiently high fixation strength.

In the image forming apparatus embodying the invention, the conditions to be fulfilled by the individual roller components such as materials, layer structures, and dimensions are not limited to those as suggested in the above-described embodiments. For example, conventional roller elements that have commonly been used in the field of electrophotographic image forming technology may be used in their as-is state or with alterations. Moreover, instead of a roller element, an endless member such as a belt may be adopted. Further, the belt components such as the intermediate transfer belt and the conveyance belt may be constructed in the form of a roller instead of the form of an endless belt.

Although the image forming apparatus according to each of the embodiments of the invention is exemplified as a tandem-type color image forming apparatus, the technique in the invention is not limited thereto, but may be applied also e.g. to a so-called 4-rotation type color image forming apparatus in which an image of one given color is superimposedly produced each time an intermediate transfer belt makes one turn. Moreover, the technique in the invention is not limited to a color image forming apparatus, but may be applied also to a monochromatic image forming apparatus.

For example, the image forming apparatus embodying the invention may be built as a copier, a printer, a facsimile, or a multi-function machine that combines two or more kinds of functions as mentioned just above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a toner image forming section for forming a toner image, which is constituted by a toner that contains binder resin and is charged as a predetermined polarity, on a toner carrying surface of a recording medium; and a fixer fluid applying section for applying a fixer fluid, which is prepared as a liquid for softening or swelling the toner, to an entirety of the toner carrying surface of the recording medium, wherein the fixer fluid applying section performs application of the fixer fluid in such a way that a quantity of applying the fixer fluid for a non-image portion of the toner carrying surface on which the toner is not carried is smaller than that for an image portion of the toner carrying surface on which the toner image is formed, in terms of application amount of the fixer fluid per unit area.

2. The image forming apparatus of claim 1, wherein the fixer fluid applying section includes a nozzle array for applying the fixer fluid in droplet form to the toner carrying surface in response to an image signal.

3. The image forming apparatus of claim 2, wherein the amount of the fixer fluid to be applied to the non-image portion of the toner carrying surface is varied according to a distance with respect to the toner image.

4. The image forming apparatus of claim 2, wherein the droplet of the fixer fluid produced by the fixer fluid applying section has a particle diameter which is 5 times smaller than a volume average particle diameter of the toner.

5. The image forming apparatus of claim 1, wherein a non-zero amount of fixer is applied to the non-image portion of the toner carrying surface.

6. An image forming apparatus comprising:

an intermediate transfer medium;

a toner image forming section for forming a toner image, which is constituted by a toner that contains binder resin and is charged as a predetermined polarity, on a toner carrying surface of the intermediate transfer medium;

a fixer fluid applying section for applying a fixer fluid, which is prepared as a liquid for softening or swelling the toner, to an entirety of the toner carrying surface of the intermediate transfer medium; and a transfer section for transferring the toner image carried on the intermediate transfer medium onto a recording medium, wherein the fixer fluid applying section performs application of the fixer fluid in such away that a quantity of applying the fixer fluid for a non-image portion of the toner carrying surface on which the toner is not carried is smaller than that for an image portion of the toner carrying surface on which the toner image is formed, in terms of application amount of the fixer fluid per unit area, and wherein a non-zero amount of fixer is applied to the non-image portion of the toner carrying surface.

7. The image forming apparatus of claim 6, wherein a surface roughness of the toner carrying surface of the intermediate transfer medium is, on the basis of a center line average roughness (Ra), set to be equal to or smaller than ⅕ of a volume average particle diameter of the toner.

8. The image forming apparatus of claim 6, wherein the fixer fluid applying section includes a coating member which has, on its surface, at least an elastically deformable porous layer for retaining the fixer fluid, and is rotatable about its axis, and wherein in a state where the coating member is rotated while being kept in pressure-contact with the toner carrying surface of the intermediate transfer medium, the fixer fluid retained in the porous layer of the coating member is applied to the toner carrying surface in a contact manner.

9. The image forming apparatus of claim 8, wherein a difference between a contact angle of the surface of the coating member with respect to the fixer fluid and a contact angle of the surface of the intermediate transfer medium with respect to the fixer fluid is equal to or smaller than 20 degrees.

10. The image forming apparatus of claim 6, wherein the intermediate transfer medium has a smooth surface that is rotatable about its axis, the fixer fluid applying section includes a coating member which has an elastic layer formed on a surface thereof, and is rotatable about its axis, the coating member is brought into contact with the intermediate transfer medium under a constant pressure force, and in a state where the coating member carrying a thin layer of the fixer fluid on its surface is rotated while being kept in pressure-contact with the intermediate transfer medium, the coating member and the intermediate transfer medium are brought into contact with each other under a pressure force such as to allow passage of the fixer fluid carried on the surface of the coating member through a contact portion between the coating member and the intermediate transfer medium.

11. The image forming apparatus of claim 10, wherein a pressure force under which the coating member and the intermediate transfer medium are brought into contact with each other is set to a linear pressure falling in a range of from 0.05 N/cm to 1.0 N/cm.

12. The image forming apparatus of claim 6, wherein the fixer fluid applying section includes a nozzle array for applying the fixer fluid in droplet form to the toner carrying surface in response to an image signal.

13. The image forming apparatus of claim 12, wherein the amount of the fixer fluid to be applied to the non-image portion of the toner carrying surface is varied according to a distance with respect to the toner image.

14. The image forming apparatus of claim 12, wherein the droplet of the fixer fluid produced by the fixer fluid applying section has a particle diameter which is 5 times smaller than a volume average particle diameter of the toner.

15. The image forming apparatus of claim 6, wherein the fixer fluid applying section includes:

an atomizer section for atomizing the fixer fluid to form misty droplets of the fixer fluid and spraying the misty droplets of the fixer fluid;

a charging section for charging the misty droplets of the fixer fluid as a polarity reverse to a polarity of the charged toner; and a transporting section for allowing the charged misty droplets of the fixer fluid to come near the toner image, and wherein the transporting section generates an electric field between the toner carrying surface and the atomizer section in a direction such as to force the charged misty droplets of the fixer fluid to move toward the toner image.

16. The image forming apparatus of claim 15, wherein a potential of the non-image portion of the toner carrying surface is identical with that of the misty droplet of the fixer fluid, or falls in between a potential of the misty droplet of the fixer fluid and a potential of the charged toner.

17. The image forming apparatus of claim 15, wherein the misty droplet of the fixer fluid produced by the fixer fluid applying section has a particle diameter which is 5 times smaller than a volume average particle diameter of the toner.

18. The image forming apparatus of claim 6, further comprising a heating section for heating the Intermediate transfer medium, wherein the toner image which is an aggregate of toner particles formed on the intermediate transfer medium and which has spaces among the toner particles, is heated to a temperature such that disappearance of the spaces among the toner particles is not caused, and then the fixer fluid is applied to the toner image in a heated state.

19. The image forming apparatus of claim 18, wherein the temperature such that disappearance of the spaces among the toner particles is not caused, is a temperature that is equal to or higher than a glass transition temperature of the binder resin contained in the toner particle and lower than a softening point of the binder resin.

20. The image fanning apparatus of claim 6, further comprising a heating section for heating the intermediate transfer medium, wherein the toner image formed on the intermediate transfer medium with use of a toner containing, in addition to a binder resin, a wax component which is lower in softening point than the binder resin, is heated to a temperature that is equal to or higher than the softening point of the wax component and lower than the softening point of the binder resin, and then the fixer fluid is applied to the toner image in a heated state.

21. The image forming apparatus of claim 20, wherein the temperature to which the toner image formed on the intermediate transfer medium is heated is a temperature close to the softening point of the wax component.

22. A fixer fluid applying roller for applying a fixer fluid to a toner image in a contact manner, comprising:

a hollow shaft;

a permeation control layer formed on an outer surface of the shaft; and a porous layer formed on the outer surface of the permeation control layer, wherein the shaft stores the fixer fluid therein and has a plurality of fixer fluid supply holes formed so as to penetrate from the outer surface to an inner wall surface of the shaft in order to feed the fixer fluid into the permeation control layer, and the permeation control layer is made of an elastically deformable material which allows impregnation of the fixer fluid and retention of the fixer fluid in an impregnated state.

23. The fixer fluid applying roller of claim 22, wherein the permeation control layer is formed of foamed rubber or a felt, and the porous layer is formed of a porous film of fluorine resin.

* * * * *